US008877680B2

(12) United States Patent
Tatewaki et al.

(10) Patent No.: US 8,877,680 B2
(45) Date of Patent: Nov. 4, 2014

(54) REVERSIBLE THERMOSENSITIVE RECORDING MEDIUM AND REVERSIBLE THERMOSENSITIVE RECORDING MEMBER

(75) Inventors: Tadafumi Tatewaki, Shizuoka (JP); Koji Yamaguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/819,124

(22) PCT Filed: Aug. 11, 2011

(86) PCT No.: PCT/JP2011/068636

§ 371 (c)(1),
(2), (4) Date: Feb. 26, 2013

(87) PCT Pub. No.: WO2012/029546

PCT Pub. Date: Mar. 8, 2012

(65) Prior Publication Data

US 2013/0157847 A1 Jun. 20, 2013

(30) Foreign Application Priority Data

Aug. 31, 2010 (JP) ..... 2010-194615

(51) Int. Cl.

| | |
|---|---|
| ***B41M 5/30*** | (2006.01) |
| ***B41M 5/337*** | (2006.01) |
| ***B41M 5/40*** | (2006.01) |
| ***B41M 5/42*** | (2006.01) |
| ***B41M 5/44*** | (2006.01) |
| ***B41M 7/00*** | (2006.01) |

(52) U.S. Cl.

CPC ..... *B41M 5/405* (2013.01); *B41M 5/305* (2013.01); *B41M 2205/40* (2013.01); *B41M 5/44* (2013.01); *B41M 2205/04* (2013.01); *B41M 5/42* (2013.01); *B41M 2205/36* (2013.01); *B41M 5/426* (2013.01)

USPC ..... 503/201; 503/200; 503/207; 503/226

(58) Field of Classification Search

CPC .... B41M 5/305; B41M 5/3233; B41M 5/333; B41M 5/3372; B41M 5/405; B41M 5/423; B41M 5/426; B41M 5/44; B41M 7/0036; B41M 7/0045; B41M 7/0054; B41M 2205/36; B41M 2205/40

USPC ..... 503/200–226

See application file for complete search history.

(56) References Cited

U.S. PATENT DOCUMENTS 5,229,189 A 7/1993 Hiyoshi et al.
5,250,346 A 10/1993 Nagai et al.

(Continued)

FOREIGN PATENT DOCUMENTS

JP 05-124360 5/1993
JP 06-210954 8/1994

(Continued)

OTHER PUBLICATIONS

International Search Report Issued for counterpart International Patent Application No. PCT/JP2011/068636 dated Nov. 8, 2011.

(Continued)

*Primary Examiner* — Bruce H Hess
(74) *Attorney, Agent, or Firm* — Cooper & Dunham LLP

(57) ABSTRACT

A reversible thermosensitive recording medium including a support, a reversible thermosensitive recording layer provided on the support and an antistatic layer, wherein the antistatic layer is provided on at least one of the reversible thermosensitive recording layer and a surface of the support opposite to the surface thereof on which the reversible thermosensitive recording layer is provided, wherein the antistatic layer contains spherical fillers and a curable conductive polymer, and wherein the spherical fillers satisfy the following Expression (1):

$$4 \leq \text{average particle diameter of the spherical fillers} / \text{thickness of the antistatic layer} \leq 6 \quad \text{Expression (1).}$$

12 Claims, 8 Drawing Sheets

(56) References Cited

U.S. PATENT DOCUMENTS

| | | | |
|---|---|---|---|
| 5,395,815 | A | 3/1995 | Ikeda et al. |
| 5,716,477 | A | 2/1998 | Yamaguchi et al. |
| 5,942,377 | A | 8/1999 | Torii et al. |
| 5,965,484 | A | 10/1999 | Kohno et al. |
| 5,981,115 | A | 11/1999 | Furuya et al. |
| 5,981,429 | A | 11/1999 | Kawamura et al. |
| 6,090,748 | A | 7/2000 | Furuya et al. |
| 6,117,562 | A | 9/2000 | Yamaguchi et al. |
| 6,140,268 | A | 10/2000 | Yamazaki et al. |
| 6,154,243 | A | 11/2000 | Tatewaki et al. |
| 6,261,992 | B1 | 7/2001 | Furuya et al. |
| 6,969,695 | B2 | 11/2005 | Kuboyama et al. |
| 6,989,349 | B2 | 1/2006 | Tatewaki et al. |
| 7,238,642 | B2 | 7/2007 | Shimbo et al. |
| 7,585,813 | B2 | 9/2009 | Shimbo et al. |
| 7,732,373 | B2 | 6/2010 | Tatewaki et al. |
| 2002/0072472 | A1 | 6/2002 | Furuya et al. |
| 2003/0114304 | A1 | 6/2003 | Arai et al. |
| 2005/0176582 | A1 | 8/2005 | Arai et al. |
| 2006/0094599 | A1 | 5/2006 | Kuboyama et al. |
| 2007/0268319 | A1 | 11/2007 | Tatewaki et al. |

FOREIGN PATENT DOCUMENTS

| | | |
|---|---|---|
| JP | 08-187941 | 7/1996 |
| JP | 10-175373 | 6/1998 |
| JP | 10-193796 | 7/1998 |
| JP | 10-250239 | 9/1998 |
| JP | 10-291372 | 11/1998 |
| JP | 11-078255 | 3/1999 |
| JP | 11-091243 | 4/1999 |
| JP | 11-254822 | 9/1999 |
| JP | 2000-094866 | 4/2000 |
| JP | 2000-251042 | 9/2000 |
| JP | 2001-063228 | 3/2001 |
| JP | 2002-103654 | 4/2002 |
| JP | 2005-193564 | 7/2005 |
| JP | 2006-240199 | 9/2006 |
| JP | 2010-149303 | 7/2010 |

OTHER PUBLICATIONS

U.S. Appl. No. 08/291,487, filed Aug. 17, 1994, Yamaguchi, et al.
U.S. Appl. No. 09/459,635, filed Dec. 13, 1999, Yamaguchi, et al.
U.S. Appl. No. 08/548,478, filed Oct. 26, 1995, Miyajima, et al.

REVERSIBLE THERMOSENSITIVE RECORDING MEDIUM AND REVERSIBLE THERMOSENSITIVE RECORDING MEMBER

TECHNICAL FIELD

The present invention relates to a reversible thermosensitive recording medium and a reversible thermosensitive recording member.

BACKGROUND ART

In recent years, a reversible thermosensitive recording medium (also called "thermosensitive reversible recording medium" and "recording medium") has attracted attention, in which an image can temporarily be formed; i.e., the image can be erased when it is unnecessary. A typical known example of the reversible thermosensitive recording medium is a reversible thermosensitive recording medium containing a polymer, a developer (e.g., a phenol compound, an aliphatic carboxylic acid compound or an organic phosphoric acid compound having a long-chain aliphatic hydrocarbon group) and a color coupler (e.g., a leuco dye) where the developer and the color coupler are dispersed in the polymer (see PTLs 1 and 2).

Such a reversible thermosensitive recording medium mainly contains, as a support, a PET film having a magnetic recording layer, and is used as a point card on the market in many cases. In addition, other various reversible thermosensitive recording media have been proposed, which include a thin support, a reversible thermosensitive recording layer provided on one surface of the support, an adhesive layer provided on the other surface of the support and various base materials where the reversible thermosensitive recording layer, the support and the adhesive layer are laminated on the various base materials (see, for example, PTLs 3 to 6).

However, these proposed reversible thermosensitive recording media are cards with limited sizes, since they are combined with an optical memory, a contact-type IC, a non-contact-type IC or magnetic recording and also, most of the base materials are thick. These cards have limited applications. Therefore, they are not suitable to an admission ticket or a sticker for a frozen food container, industrial product, every type of chemical container or the like, or large screen and various displays for physical distribution control, manufacturing process management or the like.

Then, for the aforementioned applications, the thermosensitive reversible recording medium must have a sheet size larger than a card size. Here, the "sheet size" means a size larger than the card size (54 mm×85 mm).

The reversible thermosensitive recording medium used as a sheet has a size larger than that of a point card or a card with a thick base material. Thus, during conveyance in a printer, the reversible thermosensitive recording media of a sheet size tend to be problematically charged as a result of, for example, contact between the reversible thermosensitive recording media and contact between each medium and a conveyance roller. In addition, the reversible thermosensitive recording medium of a sheet size has a larger contact area and thus problematically accumulates a larger amount of electrostatic charges. As a result, in an assembly line of electronic parts or the like, when a paper sheet called an inspection sheet, an operation instruction sheet or a process management sheet is replaced with a sheet of a reversible thermosensitive recording medium having accumulated electrostatic charge which is selected by an operator from the reversible thermosensitive recording media stacked on a discharge tray of the printer, the electrostatic charge of the reversible thermosensitive recording medium problematically destroys products such as electronic parts. Also, the reversible thermosensitive recording media stick to each other due to the accumulated electrostatic charge, making it difficult for them to be fed from a feeding tray of the printer. Furthermore, in each reversible thermosensitive recording medium, the degree of curling, which is due to shrinkage after repetitive printing/erasing with heat, becomes large to problematically cause failure in conveyance.

In view of this, some reports have been presented on a reversible thermosensitive recording medium having an improved antistatic property to solve the above problems.

First, there has been proposed a thermosensitive reversible recording medium which, under 20° C. and 65% RH, has a surface resistance of $1\times10^{13}$ Ω/sq. or lower and a coefficient of a surface static friction of 0.65 or lower (see PTL 7).

This proposed thermosensitive reversible recording medium, however, shows a lowered surface resistance when measured under low humidity environments. In particular, when the surface resistance is equal to or lower than $1\times10^{9}$Ω/sq., the reversible thermosensitive recording medium cannot sufficiently be charge-eliminated under low humidity environments. As a result, when repetitively printed and erased under low humidity environment, the reversible thermosensitive recording media are charged and stick to each other in the printer, causing problematic failure in conveyance. Also, curling becomes severe after repetitive use and thus causes failure in conveyance in the printer.

Second, there has been proposed a reversible thermosensitive recording medium containing conductive powder having a minor axis of 1 μm or less (see PTL 8).

According to this proposal, dust attached onto the reversible thermosensitive recording medium is reduced. However, this literature neither discloses nor suggests surface conditions of the reversible thermosensitive recording medium. Actually, the surface conditions of the reversible thermosensitive recording medium raise difficulties in conveying the reversible thermosensitive recording medium with a feeding roller, when the reversible thermosensitive recording media are conveyed in a superposed manner in the printer. As a result, the sheets cannot be separated from one another to cause failure in conveyance. In addition, when repetitively printed and erased, the reversible thermosensitive recording medium is curled due to heat applied during printing/erasing, which causes failure in conveyance in the printer.

Third, there has been proposed a reversible thermosensitive recording medium having one or more of a layer containing conductive metallic oxide semiconductor powder which is a conductive pigment coated with tin oxide (see PTL 9).

However, this literature does not describe surface conditions of the reversible thermosensitive recording medium similar to the above literature. Actually, the surface conditions of the reversible thermosensitive recording medium raise difficulties in conveying the reversible thermosensitive recording medium with a feeding roller, when the reversible thermosensitive recording media are conveyed in a superposed manner in the printer. In addition, when repetitively printed and erased, the reversible thermosensitive recording medium is curled due to heat applied during printing/erasing, which causes failure in conveyance in the printer.

Meanwhile, in the field of a thermal transfer image receiving sheet (thermosensitive recording medium), some reports have been presented on examples in which an antistatic property has been improved.

First, there has been proposed a thermal transfer image receiving sheet containing conductive needle crystals (see PTL 10).

However, when this proposed thermal transfer image receiving sheet is used directly as a reversible thermosensitive recording medium, sufficient antistatic effect cannot be obtained. This literature does not describe an example in which an antistatic layer is provided on the uppermost surface thereof. In this case, the thermal transfer image receiving sheet becomes relatively difficult to convey in the printer. Furthermore, during repetitive printing/erasing of this proposed thermal transfer image receiving sheet used as the reversible thermosensitive recording medium, the reversible thermosensitive recording media stick to each other, potentially causing multi feed. Also, curling is not sufficiently prevented from occurring, and the reversible thermosensitive recording medium is progressively curled due to heat applied during repetitive printing/erasing, finally leading to failure in conveyance.

Second, there has been proposed a thermosensitive recoding medium including a back layer containing a conductive polymer and spherical fillers (see PTL 11).

This proposed thermosensitive recoding medium exhibits advantageous effects from the viewpoint of preventing static charge and sticking between the media. However, even when the thermosensitive recoding medium is used directly as a reversible thermosensitive recording medium, such effects of preventing static charge and sticking between the media cannot be sufficiently obtained. Furthermore, during repetitive printing/erasing, this reversible thermosensitive recoding medium involves scratches, and is progressively curled due to heat applied during repetitive printing/erasing, finally leading to failure in conveyance.

To solve the above problems, there has been reported a reversible thermosensitive recording medium having an improved effect of preventing curling.

For example, there has been proposed a reversible thermosensitive recording medium including a protective layer (front surface) and a back coating layer both of which being formed of a UV ray curable polymer, wherein a dynamic friction coefficient is 0.3 or higher between the surfaces of the protective layer and the back coating layer and a dynamic friction coefficient is 0.3 or lower between the surfaces of the protective layers (PTL 12).

This proposed reversible thermosensitive recording medium has an effect of preventing curling. However, when used directly, the reversible thermosensitive recording medium is charged after repetitive printing/erasing. As a result, the reversible thermosensitive recording media stick to each other, causing failure in conveyance. In addition, the surface property of the reversible thermosensitive recording medium changes due to heat and pressure applied by a head as well as heating by an erasing unit during repetitive printing/erasing, causing failure in conveyance. Furthermore, when the reversible thermosensitive recording medium is mistakenly set in the printer such that the front and back surfaces are upset, the difference in friction coefficient is caused between the back surfaces or between the protective layers, causing failure in conveyance.

Also, there is proposed a reversible thermosensitive recording medium having improved antistatic effect and curling preventive effect, which includes a back layer containing conductive needle fillers of titanium oxide coated with antimony-doped tin oxide and a UV ray curable polymer (see PTL 13).

This proposed reversible thermosensitive recording medium has good antistatic effect and curling preventive effect. This literature, however, does not describe prevention of sticking between the media. In the operation sites, the media stick to each other via water, oil or the like, potentially causing multi feed. In addition, antimony is a harmful substance to the environment. Thus, demand has arisen for development of a reversible thermosensitive recording medium formed of a material having less environmental load.

As described above, at present, there have not been provided yet reversible thermosensitive recording media and relevant arts which meet all of the requirements of preventing static charging, curling, sticking between media due to oil, water or the like in use, and scratch formation after repetitive printing/erasing, as well as the requirement of exhibiting excellent conveyance property, although there are some methods of preventing static charging and curling.

CITATION LIST

Patent Literature

PTL 1: Japanese Patent Application Laid-Open (JP-A) No. 05-124360
PTL 2: JP-A No. 06-210954
PTL 3: JP-A No. 2000-094866
PTL 4: JP-A No. 2000-251042
PTL 5: JP-A No. 2001-063228
PTL 6: JP-A No. 2002-103654
PTL 7: JP-A No. 11-254822
PTL 8: JP-A No. 10-250239
PTL 9: JP-A No. 11-091243
PTL 10: JP-A No. 11-078255
PTL 11: JP-A No. 2006-240199
PTL 12: JP-A No. 08-187941
PTL 13: JP-A No. 2005-193564

SUMMARY OF INVENTION

Technical Problem

The present invention aims to solve the above existing problems and solve the following objects. Specifically, an object of the present invention is to provide a reversible thermosensitive recording medium which meets all of the requirements of preventing static charging, curling, sticking between media due to oil, water or the like in use, and scratches after repetitive printing/erasing, as well as the requirement of exhibiting excellent conveyance property; and a reversible thermosensitive recording member.

Solution to Problem

Means for solving the above existing problems are as follows.

<1> A reversible thermosensitive recording medium including:

a support, a reversible thermosensitive recording layer provided on the support and an antistatic layer, wherein the antistatic layer is provided on at least one of the reversible thermosensitive recording layer and a surface of the support opposite to the surface thereof on which the reversible thermosensitive recording layer is provided, wherein the antistatic layer contains spherical fillers and a curable conductive polymer, and wherein the spherical fillers satisfy the following Expression (1):

$$4 \leq \text{average particle diameter of the spherical fillers} / \text{thickness of the antistatic layer} \leq 6 \quad \text{Expression (1)}$$

<2> The reversible thermosensitive recording medium according to <1>, wherein a surface of the antistatic layer is covered with the spherical fillers at a coverage of 2% to 10%.

<3> The reversible thermosensitive recording medium according to <1> or <2>, wherein the average particle diameter of the spherical fillers is 10 μm to 20 μm.

<4> The reversible thermosensitive recording medium according to any one of <1> to <3>, wherein the thickness of the antistatic layer is 1 μm to 5 μm.

<5> The reversible thermosensitive recording medium according to any one of <1> to <4>, wherein the antistatic layer has a surface resistance of $1\times10^{9}\Omega$/sq. or lower.

<6> The reversible thermosensitive recording medium according to any one of <1> to <5>, wherein the curable conductive polymer is a UV-curable conductive polymer.

<7> The reversible thermosensitive recording medium according to <6>, wherein the UV-curable conductive polymer has at least one main skeleton selected from the group consisting of polythiophene, polyparaphenylene, polyaniline and polypyrrole.

<8> The reversible thermosensitive recording medium according to any one of <1> to <7>, wherein the reversible thermosensitive recording layer contains an electron donating coloring compound and an electron accepting compound.

<9> The reversible thermosensitive recording medium according to <8>, wherein the electron accepting compound is a phenol compound containing an alkyl chain having 8 or more carbon atoms.

<10> The reversible thermosensitive recording medium according to <8> or <9>, wherein the electron donating coloring compound is a leuco dye.

<11> The reversible thermosensitive recording medium according to any one of <1> to <10>, wherein the reversible thermosensitive recording medium is processed into a card or a sheet.

<12> A reversible thermosensitive recording member including:

an information storage section, and a reversible display section, wherein the reversible display section contains the reversible thermosensitive recording medium according to any one of <1> to <11>.

<13> The reversible thermosensitive recording member according to <12>, wherein the information storage section and the reversible display section are integrated.

<14> The reversible thermosensitive recording member according to <12> or <13>, wherein the information storage section is selected from the group consisting of a magnetic recording layer, a magnetic stripe, an IC memory, an optical memory, an RF-ID tag card, a disc, a disc cartridge and a tape cassette.

<15> The reversible thermosensitive recording member according to any one of <12> to <14>, further including a printable section.

Advantageous Effects of Invention

The present invention can provide a reversible thermosensitive recording medium which meets all of the properties of preventing static charging, curling, sticking between media due to oil, water or the like in use, and scratches after repetitive printing/erasing, as well as an excellent conveyance performance; and a reversible thermosensitive recording member. These can solve the above existing problems and achieve the above objects.

Figure 1:
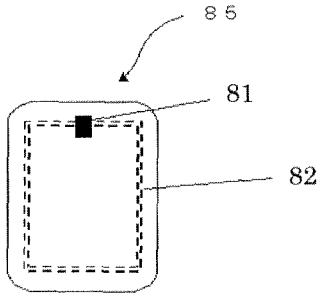
FIG. 1 is a schematic view of one exemplary RF-ID tag.

DESCRIPTION OF EMBODIMENTS (Reversible Thermosensitive Recording Medium)

A reversible thermosensitive recording medium of the present invention includes at least a support, a reversible thermosensitive recording layer and an antistatic layer; and, if necessary, further includes other layers such as a protective layer and a back layer.

<Support>

The shape, structure and size of the support are not particularly limited and may be appropriately selected depending on the intended purpose. Regarding the shape, the support has a flat shape, for example. Regarding the structure, the support may have a single-layered structure or a multi-layered structure. Regarding the size, the size of the reversible thermosensitive recording medium may be appropriately selected depending on the intended purpose.

Examples of the material of the support include inorganic materials and organic materials. Examples of the inorganic materials include glass, quartz, silicon, silicon oxide, aluminum oxide, $SiO_2$ and metal. Examples of the organic materials include paper, cellulose derivatives such as cellulose triacetate, synthetic paper, polyethylene terephthalate, polycarbonate, polystyrene, and polymethyl methacrylate. These may be used alone or in combination.

For the purpose of improving adhesion of the coating layer, the support is preferably modified by a corona discharge treatment, an oxidation treatment (using, for example, chromic acid), an etching treatment, an easy adhesive treatment, or an antistatic treatment. The support is preferably whitened by adding a white pigment such as titanium oxide.

The thickness of the support is not particularly limited and may be appropriately selected depending on the intended purpose. It is preferably 50 μm to 2,000 μm, more preferably from 100 μm to 1,000 μm.

<Reversible Thermosensitive Recording Layer>

The reversible thermosensitive recording layer is a thermosensitive recording layer which reversibly changes in color toner and which contains at least a reversible thermosensitive recording material reversibly changing in color depending on the temperature, preferably contains a binder polymer; and, if necessary, further contains other ingredients. The reversible thermosensitive recording material changes in color by a combination of changes in light transmittance, reflectance, absorption wavelength and scattering degree.

The reversible thermosensitive recording material is not particularly limited, as long as its transparency and color tone reversibly change through application of heat, and may be appropriately selected depending on the intended purpose. Examples thereof include a material which becomes the state of first color at a first temperature higher than a normal temperature, and becomes the state of second color by heating at a second temperature higher than the first temperature, followed by cooling. Among others, particularly preferred is a material wherein the state of color changes at the first temperature and the second temperature.

Specific examples thereof include a material which becomes a transparent state at the first temperature and becomes an opaque state at the second temperature (see JP-A No. 55-154198), a material wherein color is developed at the second temperature and the color is erased at the first temperature (see JP-A Nos. 04-224996, 04-247985 and 04-267190), a material which becomes an opaque state at the first temperature and becomes a transparent state at the second temperature (see JP-A No. 03-169590) and a material wherein black, red and blue colors are developed at the first temperature and the colors are erased at the second temperature (JP-A Nos. 02-188293 and 02-188294). In particular, preferred is a system employing an electron donating coloring compound (color coupler) and an electron accepting compound (developer) described below.

<<Electron Donating Coloring Compound>>

The electron donating coloring compound is not particularly limited and may be appropriately selected depending on the intended purpose. Examples thereof include a leuco dye.

The leuco dye is a colorless or pale-colored precursor of a dye, which is not particularly limited and may be appropriately selected from those conventionally known in the art. Examples thereof include leuco compounds such as triphenylmethane phthalide compounds, triallymethane compounds, fluoran compounds, phenothiazine compounds, thiofluoran compounds, xanthene compounds, indophthalyl compounds, spiropyran compounds, azaphthalide compounds, couromeno-pyrazole compounds, methine compounds, rhodamineanilino-lactam compounds, rhodaminelactam compounds, quinazoline compounds, diazaxanthene compounds and bislactone compound. Among them, leuco dyes of fluoran compounds and phthalide compounds are preferred from the viewpoints of exhibiting excellent color-developing/erasing properties, color, storageability, etc. The leuco dyes of fluoran compounds and phthalide compounds are not particularly limited and may be appropriately selected depending on the intended purpose. Examples thereof include black color-developing leuco dyes such as 3-diethylamino-6-methyl-7-anilinofluoran, 3-(N-ethyl-N-p-toluidinoamino-6-methyl-7-anilinofluoran, 3-di(n-butylamino)-6-methyl-7-anilinofluoran and 3-n-methyl-N-propylamino-6-methyl-7-anilinofluoran; red color-developing leuco dyes such as 3-diethylamino-7,8-benzofluoran, 3-(N-ethyl-N-isoamyl)-7,8-benzofluoran, 1,3-dimethyl-6-diethylaminofluoran, 1,3-dimethyl-6-di-n-butylaminofluoran, 3-diethylamino-7-methylfluoran and 3,3-bis(1-n-butyl-2-methylindol-3-yl)phthalide; blue color-developing leuco dyes such as crystal violet lactone, 3-(4-diethylamino-2-ethoxyphenyl)-3-(1-ethyl-2-methylindol-1-yl)-4-azaphthalide and 3-(4-diethylaminophenyl)-3-(1-ethyl-2-indol-3-yl) phthalide; leuco dyes having absorption in the infrared region such as 10-diethylamino-2-ethylbenzo[1,4]thiazino[3,2-b] fluoran, 3,3-bis(1-n-butyl-2-methylindol-3-yl)phthalide, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide and 3-[1,1-bis(4-diethylaminophenyl)ethylen-2-yl]-6-dimethylaminophthalide. Among them, from the viewpoints of exhibiting good color tone and color-developing/erasing properties, preferred are 2-anilino-3-methyl-6-disubstituted aminofluorans such as 2-anilino-3-methyl-6-diethylaminofluoran and 2-anilino-3-methyl-6-di(n-butylamino)fluoran; crystal violet lactone, 3-(4-diethylamino-2-ethoxyphenyl)-3-(1-ethyl-2-methylindol-1-yl)-4-azaphthalide. These may be used alone or in combination. Layers developing different colors may be laminated on top of one another to attain multi color or full color.

<<Electron Accepting Compound>>

The electron accepting compound is not particularly limited, as long as it can reversibly conduct color development and color erasure by means of heat as a factor. Preferred are compounds each having, in the molecule, one or more selected from (1) a structure having developing capability of conducting color development of an electron donating coloring compound (color coupler) (for example, phenolic hydroxyl group, carboxylic acid group and phosphoric acid group) and (2) a structure of controlling an intermolecular cohesive force (for example, structure linked with a long chain hydrocarbon group). The linking moiety may contain a divalent or multivalent linking group containing a hetero atom, and also the long chain hydrocarbon group may have at least one of the same linking group or an aromatic group. Particularly preferred is a phenol compound represented by the following General Formula (1) and having 8 or more carbon atoms.

General Formula (1)

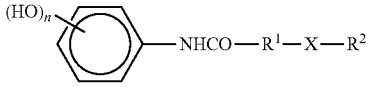

In General Formula (1), n is an integer of 1 to 3.

$R^1$ represents a substituted or unsubstituted aliphatic hydrocarbon group having 2 or more carbon atoms, preferably 5 or more carbon atoms, more preferably 10 or more carbon atoms. $R^2$ represents an aliphatic hydrocarbon group having 1 to 14 carbon atoms, preferably 8 to 14 carbon atoms. These may be used alone or in combination.

The aliphatic hydrocarbon group may be linear or branched and may have an unsaturated bond. Examples of the substituent bonded to the hydrocarbon group include a hydroxyl group, a halogen atom and an alkoxy group.

When the sum of the carbon atoms contained in the groups represented by $R^1$ and $R^2$ is 7 or less, color erasing property and stability upon color development decrease. Thus, the sum of the carbon atoms contained in the groups $R^1$ and $R^2$ is preferably 8 or more, more preferably 11 or more.

X represents a divalent group containing a N or O atom, preferably an amide group or urea group, further preferably an urea group.

By using the electron accepting compound (developer) in combination with a compound having in the molecule at least one of a —NHCO— group and at least one of a —OCONH— group and serving as a color erasure accelerator, intermolecular action is induced between the color erasure accelerator and the developer in the process of achieving the erased state whereby color-developing/erasing properties are improved, which is preferred. The color erasure accelerator is not particularly limited and may be appropriately selected depending on the intended purpose. Preferred examples thereof include those represented by the following General Formulas (2) to (8).

$R^1$—NHCO—$R^2$ General Formula (2)

$R^1$—NHCO—$R^3$—CONH—$R^2$ General Formula (3)

$R^1$—CONH—$R^3$—NHCO—$R^2$ General Formula (4)

$R^1$—NHCOO—$R^2$ General Formula (5)

$R^1$—NHCOO—$R^3$—OCONH—$R^2$ General Formula (6)

$R^1$—OCONH—$R^3$—NHCOO—$R^2$ General Formula (7)

General Formula (8)

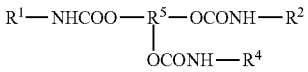

In General Formulas (2) to (8), $R^1$, $R^2$ and $R^4$ each represent at least one of a C7-C22 linear alkyl group, a C7-C22 branched alkyl group and a C7-C22 unsaturated alkyl group. $R^3$ represents a C1-C10 divalent functional group. $R^5$ represents a C4-C10 trivalent functional group.

The mixing ratio of the electron donating coloring compound (color coupler) to the electron accepting compound (developer) is not unconditionally defined because a suitable range varies depending on a combination of compounds to be used, and a molar ratio of a developer to a color coupler is preferably 0.1/1 to 20/1, more preferably 0.2/1 to 10/1. When the amount of the developer is more than the upper limit or less than the lower limit of the above range, the density of the color-developed state decreases problematically.

Also, when using the color erasure accelerator, the amount of the color erasure accelerator is preferably 0.1% by mass to 300% by mass, more preferably 3% by mass to 100% by mass, with respect to the developer. Notably, the color coupler and the developer can be used in the state of being encapsulated in a microcapsule.

<<Binder Polymer>>

The binder polymer is not particularly limited, so long as it can bind the reversible thermosensitive recording layer on the support, and may be appropriately selected depending on the intended purpose. As the binder polymer, conventionally known polymers may be used alone or in combination. Among others, to improve durability during repetitive use, more preferred are polymers curable with heat, ultraviolet rays or electron beams. Particularly preferred are heat-curable polymers containing a crosslinking agent such as an isocyanate compound.

The heat-curable polymer is not particularly limited and may be appropriately selected from known polymers depending on the intended purpose. Examples thereof include polymers each having a reactive group with the crosslinking agent (e.g., a hydroxyl group or a carboxyl group) and polymers produced through copolymerization between a monomer having a hydroxyl group, a carboxyl group, etc. and another monomer. Specific examples thereof include phenoxy polymers, polyvinyl butyral polymers, cellulose acetate propionate polymers, cellulose acetate butyrate polymers, acrylpolyol polymers, polyester polyol polymers and polyurethane polyol polymers. Among them, particularly preferred are acrylpolyol polymers, polyester polyol polymers and polyurethane polyol polymers.

In the reversible thermosensitive recording layer, the mixing ratio by mass between the color coupler and the binder polymer is preferably 1 (color coupler): 0.1 to 10 (binder polymer). When the amount of the binder polymer is too small, the heat resistance of the reversible thermosensitive recording layer may be insufficient. Whereas when the amount of the binder polymer is too large, the density of developed color may decrease problematically.

<<Other Ingredients>>

The other ingredients contained in the reversible thermosensitive recording layer are not particularly limited and may be appropriately selected depending on the intended purpose. Examples thereof include a crosslinking agent, a surfactant, a plasticizer, a conductive agent, fillers, an antioxidant, a photostabilizer, a color development stabilizer and a color erasure accelerator.

The crosslinking agent is not particularly limited and may be appropriately selected depending on the intended purpose. Examples thereof include isocyanates such as hexamethylene diisocyanate (HDI), tolylene diisocyanate (TDI) and xylylene diisocyanate (XDI); adducts of these with trimethylolpropane, etc.; burette-type thereof; isocyanurates thereof; and blocked isocyanates.

Notably, when the reversible thermosensitive recording layer is crosslinked, the gel fraction of the reversible thermosensitive recording layer crosslinked is preferably 30% or higher, more preferably 50% or higher, further preferably 70% or higher. When the gel fraction is less than 30%, the reversible thermosensitive recording layer may be poor in durability since the crosslinking degree is not sufficient.

The surfactant is not particularly limited and may be appropriately selected from known surfactants depending on the intended purpose. Examples thereof include an anionic surfactant, a cationic surfactant, a nonionic surfactant and an amphoteric surfactant.

The plasticizer is not particularly limited and may be appropriately selected depending on the intended purpose. Examples thereof include phosphate esters, fatty acid esters, phthalate esters, dibasic acid esters, glycols, polyester plasticizers and epoxy plasticizers.

—Method for Forming Reversible Thermosensitive Recording Layer—

The method for forming the thermosensitive recording layer is not particularly limited and may be appropriately selected depending on the intended purpose. Examples thereof include (1) a method including coating a support with a coating solution for a reversible thermosensitive recording layer, which is prepared by dissolving or dispersing in a solvent the binder polymer, the electron donating coloring compound and the electron accepting compound, and vaporizing the solvent thereby to form into a sheet and to crosslink the sheet simultaneously or after forming into the sheet, (2) a method including coating a support with a coating solution for a reversible thermosensitive recording layer, which is prepared by dispersing the electron donating coloring compound and the electron accepting compound in a solvent containing only the binder resin dissolved therein, and vaporizing the solvent thereby to form into a sheet and to crosslink the sheet simultaneously or after forming into the sheet, and (3) a method including heating, melting and mixing the binder resin, the electron donating coloring compound and the electron accepting compound without using a solvent, forming the molten mixture into a sheet, followed by cooling and crosslinking. In these methods, it is also possible to form into a sheet-shaped reversible thermosensitive recording medium without using a support.

The solvent used in the method (1) or (2) varies depending on, for example, the type of the binder polymer, the electron donating coloring compound and the electron accepting compound and can not be unconditionally defined. Examples thereof include tetrahydrofuran, methyl ethyl ketone, methyl isobutyl ketone, chloroform, carbon tetrachloride, ethanol, toluene and benzene. Notably, the electron accepting compound is dispersed in the form of particles in the reversible thermosensitive recording layer.

In order for the reversible thermosensitive recording layer to exhibit high performances suited as a coating material, various pigments, defoamers, pigments, dispersing agents, slipping agents, antiseptics, crosslinking agents and plasticizers may be added to the coating solution for a reversible thermosensitive recording layer.

The method for coating of the coating solution for a reversible thermosensitive recording layer is not particularly limited and may be appropriately selected depending on the intended purpose. For example, while a roll-shaped continuous support or a support cut into a sheet is being conveyed, the support is coated with the coating solution using a known method such as blade coating, wire bar coating, spray coating, air knife coating, bead coating, curtain coating, gravure coating, kiss coating, reverse roll coating, dip coating or die coating method.

The drying conditions of the coating solution for a reversible thermosensitive recording layer are not particularly limited and may be appropriately selected depending on the intended purpose. For example, the temperature is about room temperature to about 140° C., and the time is about 10 min to about 1 hour.

In particular, to perform defect-free coating, the coating liquid may be treated previously or during feeding as follows, to thereby remove foreign matter, prevent bubbles from being included, and prevent aggregation of dispersoids. Specifically, the coating liquid is allowed to pass through a generally-used filter paper, a net (e.g., a stainless mesh or a Nylon mesh), a natural or synthetic fiber filter (e.g., a cotton filter or fiber carbon filter) or a membrane (e.g., a membrane filter). Alternatively, the coating liquid is ultrasonically treated for 1 min to 200 hours, preferably 10 min to 80 hours.

Also, the coating is preferably performed in a clean room of class 10,000 or lower. The drying is preferably performed as follows. Specifically, air or an inert gas such as nitrogen is allowed to pass through a filter and a dehumidifier and then heated, and the thus-treated gas is brown to the front surface, the rear surface or both of these surfaces. Among others, filtration using a cotton filter or a membrane filter, and ultrasonic treatment are preferably performed. The above-described apparatuses are appropriately selected and employed to improve uniformity of the coating layer.

The binder polymer in the reversible thermosensitive recording layer can be cured through, for example, heating, UV irradiation and electron beam irradiation.

When the binder polymer in the reversible thermosensitive recording layer is a heat-curable polymer, it is preferred that curing be optionally performed after coating and drying. This curing can promote crosslinking in the case of thermal crosslinking. In other cases, the curing can reduce the residual solvent to stabilize quality. The curing may be performed through thermal treatment at a relatively high temperature for a short time or at a relatively low temperature for a long time using, for example, a thermostat bath. The curing conditions are not particularly limited and may be appropriately selected depending on the intended purpose. In terms of reactivity, the curing is preferably performed through heating at about 30° C. to about 130° C. for about 1 min to about 150 hours, more preferably at 40° C. to 100° C. for about 2 min to about 120 hours. Also, a crosslinking step may be provided in addition to the drying step. The conditions of the crosslinking step are not particularly limited and may be appropriately selected depending on the intended purpose. The crosslinking step is preferably performed through heating at 40° C. to 100° C. for about 2 min to about 120 hours.

The ultraviolet irradiation may be performed using a known ultraviolet ray irradiation device. Examples of the device include those equipped with, for example, a light source, a lighting fixture, a power supply, a cooling device and a conveyance device.

The light source is not particularly limited and may be appropriately selected depending on the intended purpose. Examples thereof include a mercury lamp, a metal halide lamp, a gallium lamp, a mercury-xenon lamp and a flash lamp. The wavelength of the light source may be appropriately selected depending on an ultraviolet absorption wavelength of a photopolymerization initiator and a photopolymerization accelerator added to a composition for a reversible thermosensitive recording medium.

The conditions of the ultraviolet irradiation are not particularly limited and may be appropriately selected depending on the intended purpose. For example, the lamp output and conveyance speed may be determined depending on the irradiation energy necessary for crosslinking the polymer.

The electron beam irradiation may be conducted using a known electron beam irradiation device. The electron beam irradiation device can be roughly classified into the following two types: scanning (scanbeam) type devices and non-scanning (areabeam) type devices. Which type is used can be determined based on the irradiation area and irradiation dose. Also, the conditions of the electron beam irradiation may be determined by a known method depending on the radiation dose necessary for crosslinking the polymer.

The thickness of the reversible thermosensitive recording layer is not particularly limited and may be selected depending on the intended purpose. It is preferably 1 μm to 20 μm, more preferably 3 μm to 15 μm.

Since the color development density decreases when the thickness of the reversible thermosensitive recording layer is too small, contrast of images may become low. On the other hand, when the thickness is too large, thermal distribution in the layer becomes broad and the areas where color development is not attained because the temperature does not reach the color developing temperature appear and thus it becomes impossible to obtain the desired color development density.

<Antistatic Layer>

The antistatic layer is the uppermost layer which is provided on at least one of the reversible thermosensitive recording layer and a surface of the support opposite to the surface thereof on which the reversible thermosensitive recording layer is provided. The antistatic layer contains at least spherical fillers and a curable conductive polymer; and, if necessary, further contains other ingredients such as other fillers, a lubricant and a colored pigment.

Here, the antistatic layer may also have a function of the below-described protective layer when provided on the reversible thermosensitive recording layer. Alternatively, the antistatic layer may also have a function of the below-described back layer when provided on the surface of the support opposite to the surface thereof on which the reversible thermosensitive recording layer.

<<Spherical Fillers>>

The spherical fillers satisfy the following Expression (1):

$$4 \leq \text{average particle diameter of the spherical fillers/thickness of the antistatic layer} \leq 6 \quad \text{Expression (1)}$$

The ratio of the average particle diameter of the spherical fillers to the thickness of the antistatic layer is not particularly limited, so long as it is 4 to 6, and may be appropriately selected depending on the intended purpose. The ratio is preferably 4.2 to 5.8, more preferably 4.5 to 5.5. When the ratio is less than 4, although water or the like on the medium surface penetrates into between the fillers through capillary action, the convex portions of the fillers protruded from the surface of the coating film are small and water forms convex forms between the fillers due to surface tension, whereby the media may stick to each other easily. Whereas when the ratio is more than 6, the spherical fillers may be exfoliated. The ratio of 4 to 6 is advantageous in preventing sticking between the media due to oil or water, preventing formation of scratches, and exhibiting good conveyance property.

Notably, sphericity of the spherical filler is preferably 0.70 to 1.00, more preferably 0.80 to 1.00, particularly preferably 0.90 to 1.00.

The coverage of the surface of the antistatic layer with the spherical fillers is not particularly limited and may be appropriately selected depending on the intended purpose. It is preferably 2% to 10%, more preferably 2% to 8%, particularly preferably 2% to 5%. When the coverage is less than 2%, the following unfavorable phenomena may occur: formation of scratches during repetitive printing and erasing; and reduction of the effect of preventing sticking between the media due to oil or water. Whereas when the coverage is more than 10%, the following unfavorable phenomena may occur: exfoliation of the spherical fillers; reduction of the effect of preventing static charging due to the surface being excessively covered therewith; and reduction of the effect of preventing sticking due to water, since water penetrating through capillary action forms convex forms between the densely-arranged fillers due to surface tension. The coverage of 2% to 5% is advantageous in preventing formation of scratches.

Here, the coverage of the surface of the antistatic layer with the spherical fillers can be measured using an electron microscopic image.

Specifically, regarding the spherical fillers present in a predetermined region, the diameter of each spherical filler is measured, and then the two-dimensionally area of the spherical filler is calculated. The measured values can be used to calculate the above coverage from the following Equation (2). Notably, when the spherical filler is coated with the curable conductive polymer, the diameter of the filler is a distance from one point located on the foot of the convex portion formed of the coated curable conductive polymer to another point located on the foot opposite to the one point across the convex portion.

$$\text{Coverage \%} = (\text{the sum of the areas of all the spherical fillers}) \times 100 / (\text{the area of the predetermined region}) \quad \text{Equation (2)}$$

Figure 14:
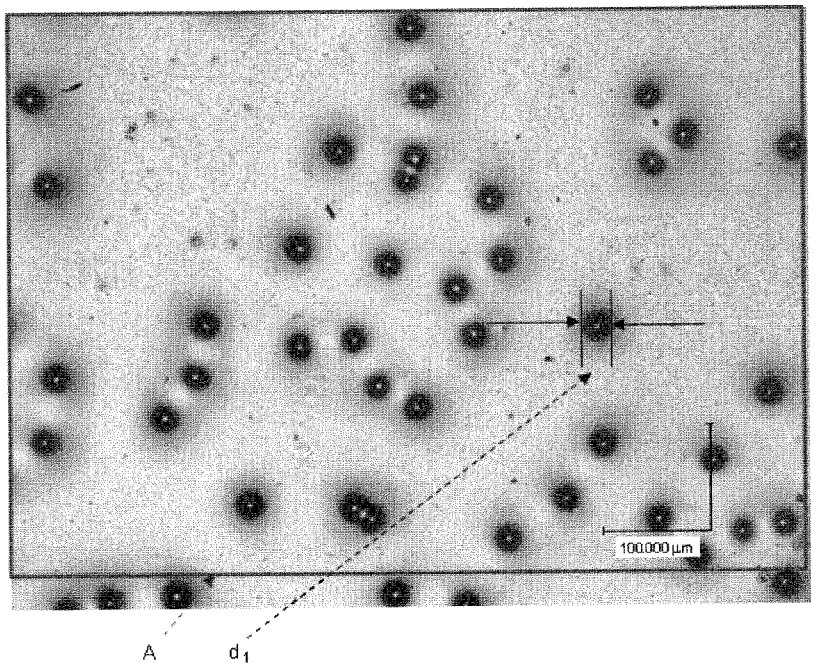
FIG. 14 is an electron-microscopic image of one exemplary antistatic layer of a reversible thermosensitive recording medium of the present invention.
Figure 15:
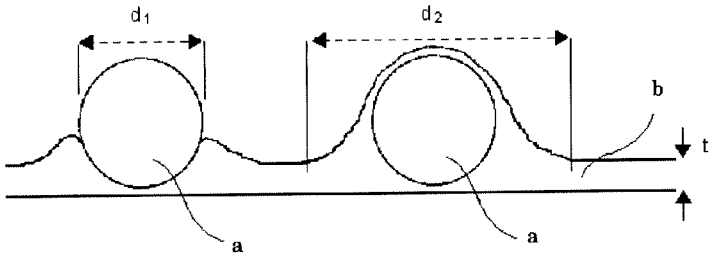
FIG. 15 is a schematic cross-sectional view of one exemplary antistatic layer of a reversible thermosensitive recording medium of the present invention, wherein "a" denotes a spherical filler and "b" denotes a binder polymer.

FIG. 14 is an electron microscopic planar image of an antistatic layer of the reversible thermosensitive recording medium of the present invention, when the antistatic layer is viewed from the thickness direction thereof. FIG. 15 is a schematic cross-sectional view of one exemplary antistatic layer of the reversible thermosensitive recording medium of the present invention. In FIG. 14, the sum of the two-dimensionally areas of all the spherical fillers located on the antistatic layer in a predetermined region (A) can be calculated as follows. Specifically, when the spherical fillers are exposed, the two-dimensionally area of each spherical filler is calculated from the diameter ($d_1$). Meanwhile, when the spherical fillers are coated with the curable conductive polymer, the two-dimensionally area of each spherical filler is calculated from the diameter ($d_2$) of the region defined by the boundary where the thickness of the curable conductive polymer is larger than the average thickness (t) thereof. Then, the sum of the areas of all the spherical fillers is calculated.

The average particle diameter of the spherical fillers is not particularly limited, so long as it satisfies the above Equation (1), and may be appropriately selected depending on the intended purpose. The average particle diameter thereof is preferably 10 μm to 20 μm, more preferably 12 μm to 18 μm, particularly preferably 13 μm to 16 μm. When the average particle diameter thereof is less than 10 μm, although water or the like on the medium surface penetrates into between the fillers through capillary action, the convex portions of the fillers protruded from the surface of the coating film are small and water forms convex forms between the fillers due to surface tension, whereby the media may stick to each other and the effect of preventing sticking cannot be obtained in some cases. Whereas when the average particle diameter thereof is more than 20 μm, the spherical fillers are exfoliated. Regarding the average particle diameter, the range of 10 μm to 20 μm is advantageous in preventing sticking between the media due to water.

Here, the "average particle diameter" refers to an average particle diameter on the volume basis (volume average particle diameter). The average particle diameter is measured by a known method such as a method using a laser diffraction particle size analyzer employing a laser diffraction/scattering method based on the Mie theory.

The thickness of the antistatic layer is not particularly limited, so long as it satisfies the above Equation (1), and may be appropriately selected depending on the intended purpose. It is preferably 1 μm to 5 μm, more preferably 2 μm to 4 μm.

When the thickness thereof is smaller than 1 μm, neither the curling preventive effect nor the antistatic effect may be obtained on the surface of the reversible thermosensitive recording layer. Whereas when the thickness thereof is greater than 5 μm, no curling preventive effect may be obtained on the surface of the antistatic layer. The thickness of 1 μm to 5 μm is advantageous in preventing static charging and curling.

Here, the thickness of the antistatic layer refers to a thickness of the binder polymer of the antistatic layer excluding the fillers such as the spherical fillers. For example, when an antistatic layer-coating liquid containing the spherical fillers is used to form an antistatic layer, the thickness of the antistatic layer is determined by measuring the thickness of the binder polymer in a region where the spherical fillers are absent. The thickness can be measured with a film thickness meter such as a stylus film thickness meter.

The "thickness" is an average thickness of the antistatic layer, which is preferably an average of thicknesses measured at 10 or more points, more preferably an average of thicknesses measured at 20 or more points, particularly preferably an average of thicknesses measured at 30 or more points.

Also in the "thickness" of each of the other layers than the antistatic layer, the "thickness" is an average thickness of the layer, which is preferably an average of thicknesses measured at 10 or more points, more preferably an average of thicknesses measured at 20 or more points, particularly preferably an average of thicknesses measured at 30 or more points.

The spherical filler is not particularly limited and may be appropriately selected depending on the intended purpose. Examples thereof include spherical inorganic fillers such as phosphate fiber, potassium titanate, magnesium hydroxide, whisker, talc, mica, glass beads flake, calcium carbonate, aluminum hydroxide, silica, clay, kaolin, calcined clay and hydrotalcite; and spherical organic fillers such as condensation polymers (e.g., polystyrene polymer, polyethylene polymer, polylpropylene polymer, urea-formalin polymer, silicone polymer, polymethyl methacrylate acylate polymer, melamine-formaldehyde polymer, polyester and polycarbonate).

The spherical filler may be commercially available products, examples of which include spherical crosslinked acryl resin fillers MX1000, MX1500, MX2000 and MX2500 (these products are of Soken Chemical & Engineering Co., Ltd.); spherical alumina fillers AO-809 and AO-820 (these products are of Admatechs Company Limited) and DAM-10 (product of DENKI KAGAKU KOGYO KABUSHIKI KAISHA); spherical calcium carbonate filler HPC-S (product of Hokkaido Cooperation Lime Corporation); spherical silica fillers H-121, H-122 and NP-100 (these products are of AGC Si-Tech. Co., Ltd.); spherical silicone polymer fillers TOSPEARL 3120 (product of Toshiba Silicone Co., Ltd.); spherical crosslinked polymethyl methacrylate fillers MBX-20 and MB30X-20 (these products are of SEKISUI PLASTICS CO. LTD.); spherical crosslinked polybutyl methacrylate filler BM30X-12 (product of SEKISUI PLASTICS CO. LTD.); spherical crosslinked polystyrene filler SBX-12 (product of SEKISUI PLASTICS CO. LTD.); spherical polyacrylate ester filler ARX-15 (product of SEKISUI PLASTICS CO. LTD.); spherical benzoguanamine-formaldehyde condensate filler EPOSTER L-15 (product of NIPPON SHOKUBAI CO., LTD.); and spherical benzoguanamine-melamine-formaldehyde condensate filler EPOSTER GP (product of NIPPON SHOKUBAI CO., LTD.).

<<Curable Conductive Polymer>>

The antistatic layer contains the curable conductive polymer as the binder polymer.

The curable conductive polymer is not particularly limited and may be appropriately selected depending on the intended purpose. Examples thereof include polymers containing, as a part thereof, a skeleton serving as a conducting moiety, such as polythiophene, polyparaphenylene, polyaniline or polypyrrole.

Also, the curable conductive polymer is not particularly limited and may be appropriately selected depending on the intended purpose. Examples thereof include an ultraviolet ray (UV)-curable conductive polymer, a heat-curable conductive polymer and an electron beam-curable conductive polymer, with a UV-curable conductive polymer being more preferred. Particularly preferred is a UV-curable conductive polymer having at least one main skeleton selected from the group consisting of polythiophene, polyparaphenylene, polyaniline and polypyrrole.

The monomer or oligomer of the UV-curable conductive polymer is not particularly limited and may be appropriately selected depending on the intended purpose. The monomer or oligomer thereof may be a commercially available product, examples of which include ASRC-1 (product of Arakawa Chemical Industries, Ltd.), SEPLEGYDA HC-A04 (product of SHIN-ETSU FINETECH CO., LTD.), Denatron P-490F and Denatron P-492 (these products are of Nagase ChemteX Corporation) and U601LPA, U201PA60 and U201PAT80 (these products are of Shin-Nakamura Chemical Co., Ltd.).

The monomer or oligomer of the heat-curable conductive polymer is not particularly limited and may be appropriately selected depending on the intended purpose. The monomer or oligomer thereof may be a commercially available product, examples of which include UR-AS601 and UR-AS625 (these products are of Arakawa Chemical Industries, Ltd.), SEPLEGYDA AS-D06 (product of SHIN-ETSU FINETECH CO., LTD.) and Denatron P-485 and Denatron P-486 (these products are of Nagase ChemteX Corporation).

To cure the monomer or oligomer of the UV-curable conductive polymer, it is necessary to use a photopolymerization initiator and a photopolymerization accelerator.

The photopolymerization initiator is roughly classified into a radical-reactive initiator (e.g., a photo-cleavable initiator and a hydrogen-drawing initiator) and an ion-reactive initiator.

The photopolymerization initiator is not particularly limited and may be appropriately selected depending on the intended purpose. Examples thereof include isobutyl benzoin ether, isopropyl benzoin ether, benzoin ethyl ether, benzoin methyl ether, 1-phenyl-1,2-propandion-2-(o-ethoxycarbonyl)oxime, 2,2-dimethoxy-2-phenylacetophenonebenzyl, hydroxycyclohexyl phenyl ketone, diacetoxyacetophenone, 2-hydroxy-2-methyl-1-phenylpropan-1-one, benzophenone, chlorothioxanthone, 2-chlorothioxanthone, isopropylthioxanthone, 2-methylthioxanthone and chlorine-substituted benzophenone.

The photopolymerization accelerator preferably has an effect of accelerating curing rate in use of hydrogen-drawing photopolymerization initiators such as benzophenones and thioxanthones. Examples thereof include aromatic tertially amines and aliphatic amines. Specific examples include p-dimethylamino benzoic acid isoamyl ester and p-dimethylamino benzoic acid ethyl ester. These may be used alone or in combination.

The amount of the photopolymerization initiator or photopolymerization accelerator is preferably 0.1% by mass to 20% by mass, more preferably 1% by mass to 10% by mass, with respect to the total mass of the resin component of the back layer.

<<Other Components>>

In addition to the spherical filler and the curable conductive polymer, the antistatic layer may further contain other components such as other fillers and a lubricant, if necessary.

The other fillers are not particularly limited and may be appropriately selected depending on the intended purpose. Examples thereof include conductive fillers.

The conductive fillers are not particularly limited and may be appropriately selected depending on the intended purpose. Examples thereof include tin oxide-coated products of, for example, titanium oxide, potassium titanate, aluminum borate, silicon carbide and silicon nitride. Among them, particularly preferred is tin oxide-coated titanium oxide, from the viewpoints of easily controlling its crystal growth and stably obtaining their crystals having a uniform size. Also, the tin oxide-coated titanium oxide has so high strength that it cannot be destroyed during dispersion for preparing a coating liquid. Thus, when formed into a coated film, the tin oxide-coated titanium oxide roughens the surface of the coated film, maintaining the surface strength and hardness, which is preferred.

The amount of the above other filler contained in the antistatic layer is preferably 1% by mass to 20% by mass.

The lubricant is not particularly limited and may be appropriately selected depending on the intended purpose. Examples thereof include synthetic waxes, vegetable waxes, animal waxes, higher alcohols, higher fatty acids, higher fatty acid esters and amides.

—Method for Forming Antistatic Layer—

The method for forming the antistatic layer is not particularly limited and may be appropriately selected depending on the intended purpose. Examples thereof include a method including mixing the spherical filler, the curable conductive polymer and the other components together in a solvent to prepare a mixture, homogeneously mixing/dispersing the resultant mixture to prepare an antistatic layer-coating liquid, and coating the thus-prepared antistatic layer-coating liquid.

The dispersing device used for dispersing the antistatic layer-coating liquid, the coating method and drying/curing method for the antistatic layer, etc. may be known methods used for the above-described reversible thermosensitive recording layer.

The solvent is not particularly limited and may be appropriately selected depending on the intended purpose. Examples thereof include water, alcohol, ketone, amide, ethers, glycols, glycolethers, glycol ester acetates, esters, aromatic hydrocarbons, aliphatic hydrocarbons, halogenated hydrocarbons, sulfoxides and pyrrolidones. Among them, preferred are water, methanol, ethanol, isopropanol, n-butanol, acetone, methyl ethyl ketone, methyl isobutyl ketone, cyclohexanone, N,N-dimethyl formamide, N,N-dimethylacetamide, tetrahydrofuran, 1,4-dioxane, 3,4-dihydro-2H-pyran, 2-methoxyethanol, 2-ethoxyethanol, 2-butoxyethanol, methyl acetate, ethyl acetate, butyl acetate, toluene, xylene, hexane, heptane, cyclohexane and dimethylsulfoxide, with water, isopropanol, n-butanol, methyl ethyl ketone, methyl isobutyl ketone, cyclohexanone, tetrahydrofuran, ethyl acetate, butyl acetate, toluene and xylene being more preferred.

Notably, the above coating liquid may be prepared with, for example, a known coating liquid-dispersing device such as a paint shaker, a ball mill, an attritor, a three-roll mill, a KEDY mill, a sand mill, a DYNO MILL and a colloid mill.

The coating method of the antistatic layer is not particularly limited and may be appropriately selected depending on the intended purpose. For example, while a roll-shaped continuous support or a support cut into a sheet is being conveyed, the support is coated with the coating liquid using a known method such as blade coating, wire bar coating, spray coating, air knife coating, bead coating, curtain coating, gravure coating, kiss coating, reverse roll coating, dip coating or die coating method. The coated sheet is, then, conveyed into an air-circulation drying apparatus, where it is dried at 30° C. to 150° C. for 10 sec to 10 min.

Examples of the method for curing the monomer or a oligomer of the curable conductive polymer in the antistatic layer include heating, UV irradiation and electron beam irradiation. For example, there can be used a known method such as the above-described method for curing the binder polymer in the reversible thermosensitive recording layer.

In the reversible thermosensitive recording medium of the present invention, when the surface resistance of the antistatic layer is $1\times10^{10}\Omega$/sq. or lower under 25° C.-60RH %, satisfactory antistatic effect can be expected to obtain. The surface resistance of the antistatic layer is preferably $1\times10^{9}\Omega$/sq. or lower under 25° C.-60RH %, more preferably $1\times10^{9}\Omega$/sq. or lower under 5° C.-30RH % to 35° C.-85RH %.

Here, the surface resistance may be measured with, for example, a known surface resistance meter.

In the present invention, the antistatic layer contains the spherical filler and the curable conductive polymer. With this configuration, it is possible to leak electrostatic charge generated due to friction between the reversible thermosensitive recording medium and the roller during conveyance or rubbing between the reversible thermosensitive recording media, instead of retaining electrostatic charge in the reversible thermosensitive recording media. This is advantageous in that sticking of the reversible thermosensitive recording medium can be prevented as well as the reversible thermosensitive recording medium does not adsorb dust causing printing failure during printing/erasing. Also, incorporation of the spherical filler and the curable conductive polymer into the antistatic layer can prevent curling and scratch formation due to repetitive thermal treatments of printing and erasing. In addition, the spherical fillers satisfy the above Expression (1) and thus, the fillers appear on the surface of the reversible thermosensitive recording medium to form concave and convex portions thereon. As a result, the conveyance property is improved, and also sticking between the media due to water, oil or the like during use can be prevented.

<Other Layers>

In addition to the support, the reversible thermosensitive recording layer and the antistatic layer, the reversible thermosensitive recording medium of the present invention may further include appropriately selected other layers such as a protective layer, a back layer, an intermediate layer, an undercoat layer, a photothermic layer, a colored layer, an air layer, a light reflection layer, an adhesion layer, an adhesive layer and a tacky layer, if necessary. Each of these layers may have a single-layered structure or a laminated structure.

<<Protective Layer>>

The reversible thermosensitive recording medium of the present invention may contain a protective layer on the reversible thermosensitive recording layer for the purpose of protecting the reversible thermosensitive recording layer. The protective layer is not particularly limited and may be appropriately selected depending on the intended purpose. For example, the protective layer may be formed of one or more layers, and is preferably provided on the uppermost surface exposed.

The protective layer may contain a binder polymer and other components. The binder polymer contained therein may be those used for the reversible thermosensitive recording layer. When the protective layer is the antistatic layer, the binder polymer is the curable conductive polymer.

The thickness of the protective layer is not particularly limited and may be appropriately selected depending on the intended purpose. For example, it is preferably 0.1 μm to 10.0 μm. When the thickness of the protective layer is smaller than 0.1 μm, the protective effect for the thermosensitive layer is not satisfactory in some cases. Whereas when the thickness thereof is greater than 10.0 μm, thermal sensitivity may be reduced.

<<Back Layer>>

The reversible thermosensitive recording medium of the present invention may contain a back layer on a surface (rear surface) of the support opposite to the surface thereof where the reversible thermosensitive recording layer is provided. The back layer is not particularly limited and may be appropriately selected depending on the intended purpose. For example, the back layer may be a single layer or may be formed of a plurality of layers. In particular, the back layer is preferably the uppermost surface exposed (uppermost rear surface).

The back layer may contain a binder polymer and, if necessary, other components such as a lubricant and a colorant. The binder polymer may be those used for the reversible thermosensitive recording layer. When the back layer is the antistatic layer, the binder polymer is the curable conductive polymer.

The thickness of the back layer is not particularly limited and may be appropriately selected depending on the intended purpose. For example, it is preferably 1 μm to 10 μm.

The lubricant is not particularly limited and may be appropriately selected depending on the intended purpose. For example, the lubricant used for the antistatic layer may be employed.

The colorant is not particularly limited and may be appropriately selected depending on the intended purpose. Examples thereof include dyes and pigments. Among them, pigments are preferred from the viewpoint of durability to repetitive thermal treatments. When the back layer is colored, it is possible to discriminate the front surface from the rear surface of the reversible thermosensitive recording medium.

In the present invention, both of the protective layer and the back layer may be the antistatic layer, or one of the protective layer and the back layer may be the antistatic layer. Preferably, at least the back layer is the antistatic layer.

In the reversible thermosensitive recording medium of the present invention, the static friction coefficient between the back layer and the protective layer, the static friction coefficient between the back layers, and the static friction coefficient between the protective layers are preferably contained in a range of 0.1 or smaller. This is because conveyance failure of the reversible thermosensitive recording media can be avoided in the printer even when the reversible thermosensitive recording media are mistakenly set such that the front and back surfaces are upset. The reversible thermosensitive recording media set in the printer are conveyed one by one with a feeding roller and a separation pad. Here, when these static friction coefficients are not contained in a range of 0.1, friction force occurs between the reversible thermosensitive recording media. As a result, the reversible thermosensitive recording media cannot be separated from one another due to the frictional force when being fed one by one with the feeding roller and the separation pad. The differences among these friction coefficients are preferably closer to 0.

Also, each of the static friction coefficients between the back layer and the protective layer, between the back layers, and between the protective layers is preferably 0.05 to 0.3.

When the static friction coefficient is lower than 0.05, one reversible thermosensitive recording medium superposed on another reversible thermosensitive recording medium is easily slid to potentially make it difficult to maintain them in a superposed state, leading to poor handleability. In addition, reversible thermosensitive recording media are easily slid relative to each other and thus, the surfaces of the reversible thermosensitive recording media are rubbed against each other to form scratches. Whereas when the static friction coefficient is higher than 0.3, frictional force between the reversible thermosensitive recording media becomes large. In the feeding system, in relation to the frictional force between the front surface of the reversible thermosensitive recording medium and the feeding roller as well as the frictional force between the rear surface of the reversible thermosensitive recording medium and the separation pad, the frictional force between the separation pad and the rear surface thereof becomes closer to or lower than the frictional force between the reversible thermosensitive recording media. As a result, the reversible thermosensitive recording media cannot be conveyed and also the design dimension of the separation pad is limited.

The reversible thermosensitive recording medium of the present invention may be processed into a desired shape depending on the intended application. For example, the reversible thermosensitive recording medium is processed into a card, a sheet, a roll, etc. In the present invention, the reversible thermosensitive recording medium is particularly preferably processed so as to have a sheet size of A5 to A4 larger than a card size (54 mm×85 mm). The reversible thermosensitive recording medium processed into a card is used as a prepaid card, a point card, a credit card, etc. The reversible thermosensitive recording medium processed into a sheet having a larger size than a card has a broader range for printing and thus, can be used as a general document, an instruction sheet for process management, etc. Furthermore, the reversible thermosensitive recording medium involves no dust and thus can also be used in, for example, a clean room.

The reversible thermosensitive recording medium of the present invention may contain a plurality of reversible thermosensitive recording layers. In this case, developed color tones of the thermosensitive recording layers may be the same or different. Also, a colored layer having any pattern formed through printing such as offset printing or gravure printing, or using an inkjet printer, a thermal transfer printer or a sublimation type printer on a part or the entirety of the same surface as the thermosensitive recording layer of the reversible thermosensitive recording medium, or a part of the opposite surface. Furthermore, an OP varnish layer made mainly of a curable resin may be provided on a part or the entity of the colored layer. Examples of the pattern include character, figure, design, photograph, and information detected with infrared rays. Also, any of the respective constituent layers can be simply colored by adding a dye or pigment thereto.

Furthermore, the reversible thermosensitive recording medium of the present invention can be provided with a hologram for security. It can also be provided with design such as human image, company mark or symbol mark by forming relief or intaglio irregularity so as to impart design properties.

More specifically, the reversible thermosensitive recording medium of the present invention can particularly suitably used for the below-described reversible thermosensitive recording member, image processing apparatus and image processing method of the present invention. In the present invention, the surface of the reversible thermosensitive recording medium means the surface on the thermosensitive recording layer side and is not limited to the protective layer, and also means the entire or partial surface which is brought into contact with the thermal head, for example, the surface of the printing layer and the surface of the OP layer in case of printing or erasing.

(Reversible Thermosensitive Recording Member)

A reversible thermosensitive recording member of the present invention includes at least an information storage section and a reversible display section including the above-described reversible thermosensitive recording medium; and, if necessary, further includes other members. Also, in the reversible thermosensitive recording member of the present invention, the information storage section and the reversible display section are preferably integrated. Furthermore, the reversible thermosensitive recording member of the present invention preferably includes a printable section.

In the reversible thermosensitive recording member of the present invention, when the reversibly-displayable reversible display section including the above-described reversible thermosensitive recording medium and the information storage section are provided on the same card (integrated) and a portion of stored information of the information storage section is displayed on the reversible display section, a card owner can confirm the information only by having a look of the card without using a special device, which is convenient. When the contents of the information storage section are rewritten, the reversible thermosensitive recording member can be repeatedly used by rewriting the display of the reversible display section.

The information storage section is not particularly limited and may be appropriately selected depending on the intended purpose. Examples thereof include a magnetic recording layer, a magnetic stripe, an IC memory, an optical memory and an RF-ID tag. Especially in a sheet medium having a size lager than a card size, an IC memory and an RF-ID tag are preferably used. Notably, the RF-ID tag (RF-ID inlet) is composed of an IC chip, and an antenna connected to the IC chip.

The reversible thermosensitive recording member of the present invention includes the reversibly-displayable reversible display section including the above-described reversible thermosensitive recording medium and the information storage section, and the information storage section is preferably an RF-ID tag. FIG. 1 is a schematic view of an RF-ID tag 85. This RF-ID tag 85 is composed of an IC chip 81, and an antenna 82 connected to the IC chip. The IC chip 81 is divided into four sections: storage section, power supply adjustment section, transmission section and reception section, and each section takes over a portion of the function and performs communication. Transfer of data is conducted through communication via electric waves between the RF-ID tag communicates and an antenna of a reader/writer. Specifically, the antenna of RF-ID receives electric waves from the reader/writer and electromotive force is generated by a resonance action through, for example, electromagnetic induction. As a result, the IC chip in the RF-ID tag is operated to signalize information in the chip to output the information from the RF-ID tag. This information is received by the antenna at the reader/writer side and recognized by a data-processing device, followed by data processing at the software side.

Figure 2:
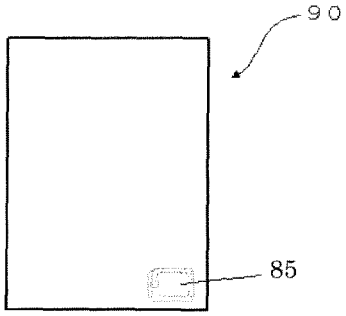
FIG. 2 is a schematic view of a reversible thermosensitive recording medium in which an RF-ID is attached to a surface of the back layer.

The RF-ID tag is processed into a label or card and, as shown in FIG. 2, the RF-ID tag 85 can be attached to the reversible thermosensitive recording medium of the present invention. The RF-ID tag 85 can be attached to the surface of the thermosensitive recording layer or that of the back layer, but is preferably attached to the surface of the back layer. To bond the RF-ID tag to the reversible thermosensitive recording medium, a known adhesive or binder can be used.

Figure 3A:
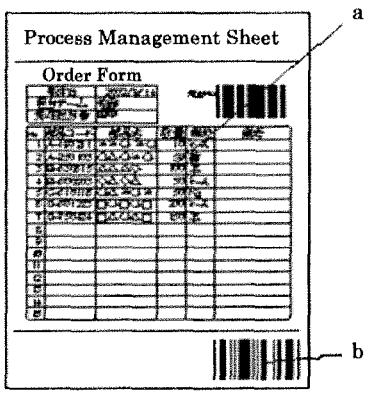
FIG. 3A is a schematic view of an example of an industrial rewritable sheet (reversible thermosensitive recording medium), wherein "a" denotes a reversible display section and "b" denotes a bar code.
Figure 3B:
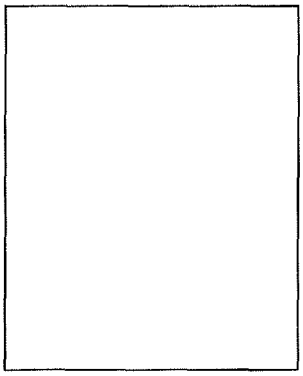
FIG. 3B is a schematic view of an example of an industrial rewritable sheet (reversible thermosensitive recording medium).

FIGS. 3A and 3B show an example wherein a reversible thermosensitive recording medium is applied to an industrial rewritable sheet (reversible thermosensitive recording member) 90. As shown in FIG. 3A, a rewritable display section is provided on the side of the thermosensitive recording layer and an RF-ID tag may not be laminated on the back side (back layer) as shown in FIG. 3B. As shown in FIG. 2, the RF-ID tag may be attached, but the RF-ID tag is preferably provided in view of improving convenience.

Figure 4:
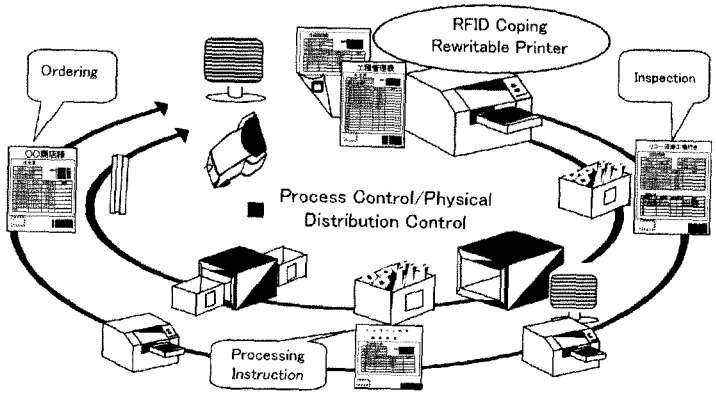
FIG. 4 is a schematic view of a way to use an industrial rewritable sheet (reversible thermosensitive recording medium).

FIG. 4 is a schematic view of a way to use an industrial rewritable sheet using the reversible thermosensitive recording medium of the present invention (rewritable sheet) and the RF-ID tag. First, information such as name and quantity of articles as materials delivered is recorded on the sheet and the RF-ID tag and attached to a tote box, followed by inspection. In the following process, processing instruction is given to the delivered materials and information is recorded on the rewritable sheet and the RF-ID tag to obtain a processing instruction book, followed by proceeding to the processing process. Then, on the processed commodity, the rewritable sheet and the RF-ID tag as an ordering instruction book, on which ordering information is recorded, and the rewritable sheet is recovered after commodity shipment and shipment information is read, and it is used again as an ordinary bill.

Figure 5:
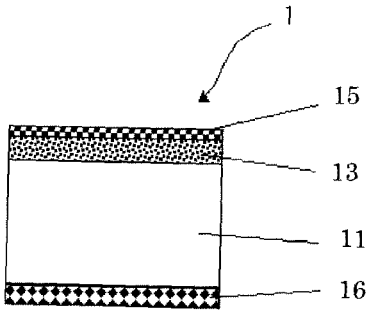
FIG. 5 is a schematic cross-sectional view of one exemplary layer structure of a reversible thermosensitive recording medium of the present invention.
Figure 6:
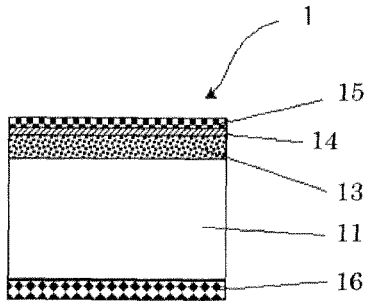
FIG. 6 is a schematic cross-sectional view of one exemplary layer structure of a reversible thermosensitive recording medium of the present invention.

The reversible thermosensitive recording medium of the present invention can include an aspect such as a film containing a support 11, a reversible thermosensitive recording layer 13 and a protective layer 15 formed on the support 11, and a back layer 16 formed on the back side of the support 11, as shown in FIG. 5, or a film containing a support 11, a reversible thermosensitive recording layer 13, an intermediate layer 14 and a protective layer 15 formed on the support 11, and a back layer 16 formed on the back side of the support 11, as shown in FIG. 6. Here, at least one of the protective layer and the back layer also has the function of the antistatic layer containing the spherical filler and the curable conductive polymer.

Figure 7A:
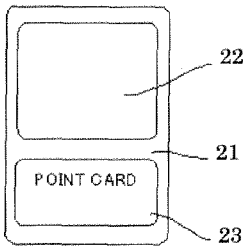
FIG. 7A schematically illustrates a front surface of one exemplary reversible thermosensitive recording member of the present invention (reversible thermosensitive recording card).
Figure 7B:
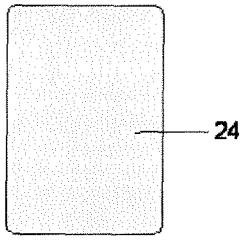
FIG. 7B schematically illustrates a back surface of one exemplary reversible thermosensitive recording member of the present invention (reversible thermosensitive recording card).

These films (reversible thermosensitive recording media) according to these aspects can be preferably used in various industrial rewritable sheets provided with the RF-ID tag 85 shown in FIG. 2. For example, as shown in FIG. 7A, it can be used as a form processed into a reversible thermorecording card 21 having a printable section 23. On the back side of the card, a magnetic recording layer and a back layer 24 are formed on the magnetic recording section, as shown in FIG. 7B.

Figure 8A:
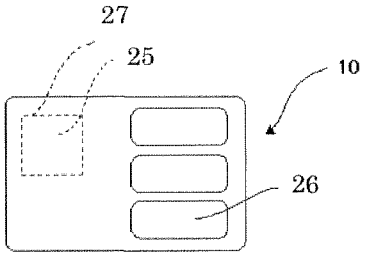
FIG. 8A schematically illustrates a front surface of one exemplary reversible thermosensitive recording member of the present invention (reversible thermosensitive recording card).
Figure 8B:
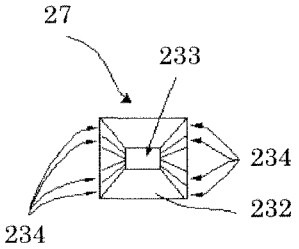
FIG. 8B schematically illustrates an IC chip embedded in a recessed portion for receiving an IC chip illustrated in FIG. 8A.

A reversible thermosensitive recording member (card) shown in FIG. 8A is obtained by processing, into a label and card, a reversible display section 26 containing a film containing a support, and a reversible thermosensitive recording layer and a protective layer formed on the support. A recessed portion 25 for receiving an IC chip is formed at a predetermined position on the back side of the card. As shown in FIG. 8B, an IC chip 27 is embedded and fixed in the recessed portion 25. In the IC ship 27, an integrated circuit 233 is provided on a wafer substrate 232 and a plurality of contact terminals 234 connected electrically to the integrated circuit 233 are provided on the wafer substrate 232. These contact terminals 234 are exposed on the back side of the wafer substrate 232 and an exclusive printer (reader/writer) serves to read or rewrite predetermined information by bringing into electrically contact with the contact terminal 234.

The reversible thermosensitive recording member of the present invention contains the reversible thermosensitive recording medium of the present invention which can prevent static charging, curling, sticking between media due to oil, water or the like in use, and scratches after repetitive printing/ erasing, as well as exhibit an excellent conveyance performance. Thus, the reversible thermosensitive recording member can be prevented from static charging, curling, sticking and scratch formation as well as be improved in conveyance performance. As a result, a desired image can be formed and erased on the reversible thermosensitive recording member at a desired timing. The formed image is excellent in contrast, visibility, etc. In the information recording section, desired various pieces of information such as character, image, music and video are recorded and erased by a recording system according to the kind of a recording medium, such as magnetic thermosensitive recording layer, magnetic stripe, IC memory, optical memory, RF-ID tag card, disk, disk cartridge or tape cassette.

At least one of the reversible thermosensitive recording label or the reversible thermosensitive recording member of the present invention is not particularly limited and image processing can be conducted by various image processing methods and image processing apparatuses, and also images are preferably formed and erased using an image processing apparatus of the present invention described below.

(Image Processing Method and Image Processing Apparatus)

The image processing apparatus of the present invention includes at least one of an image forming unit and an image erasing unit; and, if necessary, further includes appropriately selected other units such as a conveying unit and a controlling unit. The image processing method of the present invention includes at least one of an image forming step and an image erasing step; and, if necessary, further includes appropriately selected other steps such as a conveying step and a controlling step.

The image processing method of the present invention can suitably be performed by the image processing apparatus of the present invention. The image forming step and the image erasing step can suitably be performed by the image forming unit and the image erasing unit, respectively. The other steps can be performed by the other units.

<Image Forming Unit and Image Forming Step>

The image forming unit is a unit configured to heat the reversible thermosensitive recording medium of the present invention thereby forming images. The image forming step is a step of heating the reversible thermosensitive recording medium of the present invention thereby forming images.

The image forming unit is not particularly limited and may be appropriately selected depending on the intended purpose. Examples thereof include a thermal head and a laser irradiation device. These may be used alone or in combination.

<Image Erasing Unit and Image Erasing Unit>

The image erasing unit is a unit configured to heat the reversible thermosensitive recording medium of the present invention thereby erasing the images. The image erasing step is a step of heating the reversible thermosensitive recording medium of the present invention thereby erasing the images.

Examples of the image erasing unit, which is configured to heat the reversible thermosensitive recording medium of the present invention thereby erasing the images, include a hot stamp, a ceramic heater, a heat roller, a heat block, hot air, a thermal head and a laser irradiation device. Among them, a ceramic heater, a thermal head, etc. are preferable.

By using the ceramic heater, the apparatus can be downsized, and also a stable erased state can be obtained and images with good contrast can be obtained. The setting temperature of the ceramic heater is not particularly limited and may be appropriately selected depending on the intended purpose. It is preferably 110° C. or higher, more preferably 112° C. or higher, particularly preferably 115° C. or higher.

By using the thermal head, the apparatus can be further downsized, and also power consumption can be decreased and a battery-driven handy type apparatus can be attained. Also, it is possible to use one thermal head which can both record and erase images. In this case, the apparatus can be still further downsized. In case of recording and erasing using one thermal head, new images may be recorded after entirely erasing old images, or it is possible to use an overwriting system wherein old images are erased at one time by changing energy every image and then new images are recorded. According to the overwriting system, the recording speed increases because the total time of recording and erasing the images decreases.

When using the reversible thermosensitive recording member (card) including the reversible display section and the information storage section, the apparatus also includes a unit configured to read out the storage of the information storage section and a unit configured to rewrite the stored information.

—Conveying Unit and Conveying Step—

The conveying unit is not particularly limited, as long as it has a function of sequentially conveying the reversible thermosensitive recording media, and may be appropriately selected depending on the intended purpose. Examples thereof include a conveyance belt, a conveyance roller, and a combination of a conveyance belt and a conveyance roller.

—Controlling Unit and Controlling Step—

The controlling unit is not particularly limited, as long as it has a function of controlling each step. Examples thereof include devices able to control each unit, such as a sequencer and a computer.

Figure 9:
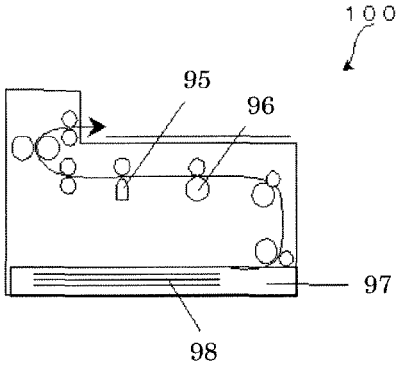
FIG. 9 is a schematic view of one exemplary image processing apparatus of the present invention.

An aspect of carrying out the image processing method of the present invention using the image processing apparatus of the present invention will now be described with reference to FIGS. 9 to 11. As shown in FIG. 9, an image processing apparatus 100 includes a heat roller 96, a thermal head 95, and a conveyance roller. In this image processing apparatus, the images recorded on the thermosensitive recording layer are erased by heating with the heat roller 96. Then, processed new information is recorded on the thermosensitive recording layer by the thermal head 95.

Figure 10:
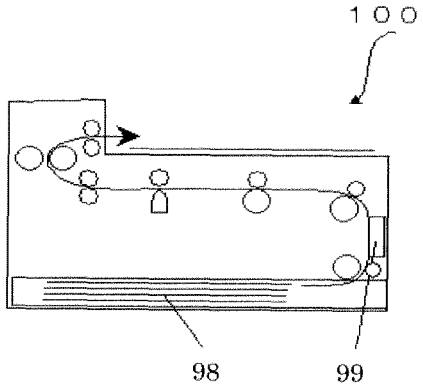
FIG. 10 is a schematic view of one exemplary image processing apparatus of the present invention.
Figure 11:
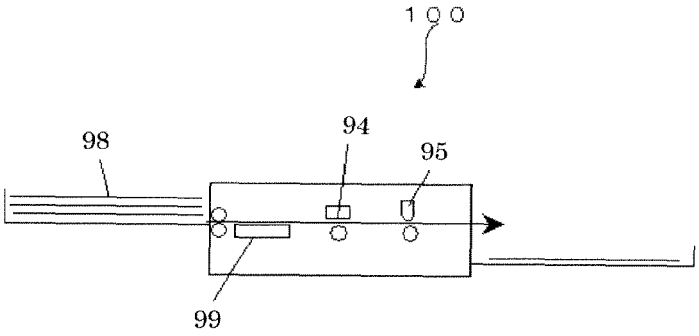
FIG. 11 is a schematic view of one exemplary image processing apparatus of the present invention.

In case the reversible thermosensitive recording medium includes an RF-ID tag, as shown in FIGS. 10 and 11, the image processing apparatus is further provided with an RF-ID reading device 99. In this case, there is also included an aspect of a parallel type image processing apparatus shown in FIG. 11.

As shown in FIGS. 10 and 11, in this image processing apparatus 100, first, information of the RF-ID tag attached to the reversible thermosensitive recording medium is read by an RF-ID reader/writer 99 and, after inputting new information into RF-ID, the images recorded on a thermosensitive recording layer by a heat roller 96 are erased with heating. Furthermore, processed new information is recorded on the thermosensitive recording layer by a thermal head based on the information which has been read and rewritten by the RF-ID reader/writer.

Instead of the RF-ID reader/writer, a bar code reader and a magnetic head may be used. In case of the bar code reader, bar code information, which has already recorded on the reversible thermosensitive recording layer, is read and then bar code and other visualized information recorded on the reversible thermosensitive recording layer are erased by the heat roller. Thereafter, new information processed based on the information read from the bar code is recorded as bar code and other visualized information on the reversible thermosensitive recording layer by the thermal head.

The image processing apparatus shown in FIG. 9 or 10 is provided with a tray 97 on which reversible thermosensitive recording media are stacked. The reversible thermosensitive recording media are picked up one by one from this tray by a paper feeding method of a friction pad system. The conveyed reversible thermosensitive recording medium is conveyed by a conveyance roller and then sent to the RF-ID reader/writer section, where data are read and written. Furthermore, the reversible thermosensitive recording medium is conveyed to the heat roller section serving as an erasing unit by the conveyance roller and visualized information recorded on the reversible thermosensitive recording medium is erased. After the reversible thermosensitive recording medium has been conveyed to the thermal head section, new information is recorded on the reversible thermosensitive recording medium. Then, the reversible thermosensitive recording medium is conveyed by the conveyance roller, and the reversible thermosensitive recording medium is discharged from an upper paper ejecting section.

The surface temperature of the heat roller is not particularly limited, so long as it is set to a temperature suited for the erasing temperature of the reversible thermosensitive recording medium, and may be appropriately selected depending on the intended purpose. The surface temperature of the heat roller is preferably 100° C. to 190° C., more preferably 110° C. to 180° C., still more preferably 115° C. to 170° C.

Furthermore, description will be made with reference to FIG. 12. An image processing apparatus shown in FIG. 12 includes a thermal head 53 serving as a heat treating unit, a ceramic heater 38, a magnetic head 34, and conveyance rollers 31, 40 and 47.

Figure 12:
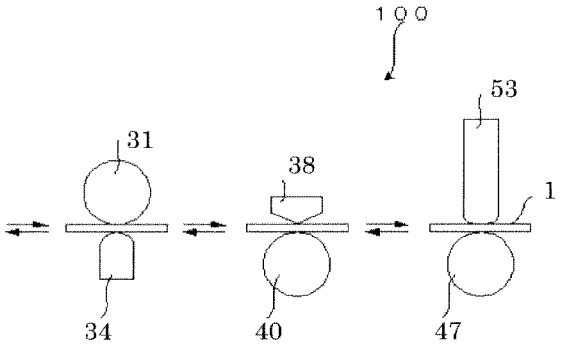
FIG. 12 is a schematic view of one exemplary image processing apparatus of the present invention.

As shown in FIG. 12, in this image processing apparatus, first, information stored in a magnetic recording layer of a reversible thermosensitive recording medium is read by a magnetic head. Then, the images recorded on the reversible thermosensitive recording layer are erased by heating with the ceramic heater. Furthermore, processed new information is recorded on the reversible thermosensitive recording layer by the thermal head based on the information read by the magnetic head. Then, the information of the magnetic recording layer is rewritten as new information.

In the image processing apparatus shown in FIG. 12, a reversible thermosensitive recording medium 1 wherein a magnetic recording layer is provided on the surface opposite to a thermosensitive recording layer is conveyed along a conveyance path shown by opposing arrows, or conveyed along the conveyance path in a reverse direction in the apparatus. The reversible thermosensitive recording medium 1 is subjected to magnetic recording or erasing on the magnetic recording layer between a magnetic head 34 and a conveyance roller 31 and thermally treated between the ceramic heater 38 and the conveyance roller 40 so as to erase the images, and then images are formed between the thermal head 53 and the region conveyance roller 47. Thereafter, the reversible thermosensitive recording medium is discharged out of the image processing apparatus. The magnetic recording may be rewritten by the ceramic heater before or after erasing the images. If desired, after passing through the ceramic heater 38 and the conveyance roller 40 or passing through the thermal head 53 and the conveyance roller 47, the reversible thermosensitive recording medium is conveyed in the conveyance path in the reverse direction. The reversible thermosensitive recording medium can be subjected again to the thermal treatment by the ceramic heater 38 and the printing treatment by the thermal head 53.

Figure 13:
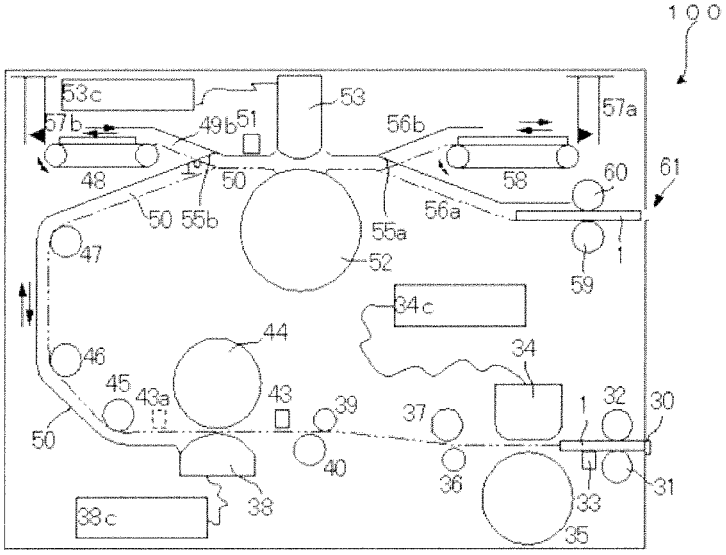
FIG. 13 is a schematic view of one exemplary image processing apparatus of the present invention.

In an image processing apparatus shown in FIG. 13, a reversible thermosensitive recording medium 1 inserted through an outlet/inlet 30 proceeds along a conveyance path 50 shown by the dotted line, or proceeds along the conveyance path 50 in the reverse direction in the apparatus. The reversible thermosensitive recording medium 1 inserted through the outlet/inlet 30 is conveyed in an image processing apparatus by a conveyance roller 31 and a guide roller 32. When the reversible thermosensitive recording medium has reached a predetermined position of the conveyance path 50, its presence is recognized by a sensor 33 through a controlling unit 34*c*. After magnetic recording or erasing has been conducted on the magnetic recording layer between a magnetic head 34 and a platen roller 35, the reversible thermosensitive recording medium is passed between a guide roller 36 and a conveyance roller 37 and passed between a guide roller 39 and a conveyance roller 40. Then, the reversible thermosensitive recording medium is thermally treated for image erasure between a ceramic heater 38 and a platen roller 44, which operate by recognition of its presence by a sensor 43 via a ceramic heater controlling unit 38*c*. Thereafter, the reversible thermosensitive recording medium is conveyed in a conveyance path 50 by conveyance rollers 45, 46 and 47. After forming images between a thermal head 53 and a platen roller 52, which operate by recognition of its presence by a sensor 51 via a thermal head controlling unit 53*c* where the sensor is located at a predetermined position, the reversible thermosensitive recording medium is discharged out of the apparatus through the conveyance path 56*a* by a conveyance roller 59 and a guide roller 60 via an outlet 61.

If desired, after being introduced into a conveyance path 56*b* by switching a conveyance path switching unit 55*a*, the reversible thermosensitive recording medium 1 is thermally treated again between the thermal head 53 and the platen roller a 52 by a conveyance belt 58 moving in the reverse direction through the operation of a limit switch 57*a* inputted by pressing the reversible thermosensitive recording medium 1. Then, the reversible thermosensitive recording medium is conveyed in the forward direction through a conveyance path 49*b* opened by switching a conveyance path switching unit 55*b*, a limit switch 57*b* and a conveyance belt 48, and then discharged out of the apparatus through the conveyance path 56*a* by the conveyance roller 59 and the guide roller 60 via the outlet 61. Furthermore, the branched conveyance path and the conveyance switching unit can also be provided at both ends of the ceramic heater 38. In this case, a sensor 43*a* is preferably provided between the platen roller 44 and the conveyance roller 45.

The image processing apparatus and the image processing method of the present invention use the reversible thermosensitive recording medium of the present invention which can prevent static charging, sticking between media due to oil, water or the like in use, scratch formation after repetitive printing/erasing, and curling as well as exhibit an excellent conveyance performance. Thus, they involve no curling of the reversible thermosensitive recording medium even after repetitive printing/erasing to prevent conveyance failures such as multi feed and jam. As a result, the image processing apparatus and method attain high-speed processing and can form high-contrast images.

Examples

The present invention will next be described by way of examples, which should not be construed as limiting the present invention thereto.

Example 1

A reversible thermosensitive recording medium of the present invention was produced according to the following procedure.

(1) Support

The support used was a whitish opaque polyester film having a thickness of 125 μm (product of Teijin DuPont Films Japan Limited, TETRON FILM U2L98W).

(2) Thermosensitive Layer (Reversible Thermosensitive Recording Layer)

—Preparation of Thermosensitive Layer-Coating Liquid—

A developer having the following Structural Formula (3 parts by mass), dialkyl urea (product of Nippon Kasei Chemical Co., Ltd., Hakreen SB) (1 part by mass), 50% by mass acrylpolyol solution (product of Mitsubishi Rayon Co., Ltd., LR327) (9 parts by mass) and methyl ethyl ketone (70 parts by mass) were pulverized and dispersed in a ball mill so as to have an average particle diameter of about 1 μm.

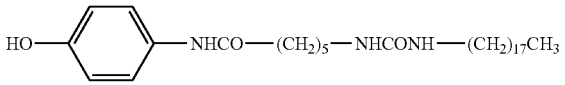

Then, 2 anilino-3-methyl-6-dibutylamino fluoran (1 part by mass) and isocyanate (product of Nippon Polyurethane Industry Co., Ltd., CORONATE HL) (3 parts by mass) were added to the above-prepared dispersion liquid containing the developer pulverized and dispersed, followed by thoroughly stirring, to thereby prepare a thermosensitive layer-coating liquid.

Next, the thus-prepared thermosensitive layer-coating liquid was applied onto the support with a wire bar, followed by drying at 100° C. for 2 min. The product obtained after the drying was cured at 60° C. for 24 hours to form a thermosensitive layer having a thickness of about 11 μm.

(3) Intermediate Layer

—Preparation of Intermediate Layer-Coating Liquid—

First, 50% by mass acrylpolyol resin solution (product of MITSUBISHI RAYON CO., LTD., LR327) (3 parts by mass), 30% by mass dispersion liquid of fine zinc oxide particles (product of Sumitomo Cement Co., Ltd., ZS303) (7 parts by mass), isocyanate (product of Nippon Polyurethane Industry Co., Ltd., CORONATE HL) (1.5 parts by mass) and methyl ethyl ketone (7 parts by mass) were thoroughly stirred to prepare an intermediate layer-coating liquid.

Next, the thus-prepared intermediate layer-coating liquid was applied with a wire bar onto the support on which the thermosensitive layer had been formed, followed by drying under heating at 90° C. for 1 min and then heating at 60° C. for 2 hours, to thereby form an intermediate layer having a thickness of about 2 μm.

(4) Protective Layer

—Preparation of Protective Layer-Coating Liquid—

Pentaerythritol hexaacrylate (product of NIPPON KAYAKU Co., Ltd., KAYARAD DPHA) (3 parts by mass), an urethane oligomer (product of Negami Chemical Industrial Co., Ltd., ART RESIN UN-3320HA) (3 parts by mass), an acrylate ester of dipentaerythritol caprolactone (NIPPON KAYAKU Co., Ltd., KAYARAD DPCA-120) (3 parts by mass) and silica (product of MIZUSAWA INDUSTRIAL CHEMICALS, LTD., P-526) (1 part by mass), a photopolymerization initiator (product of Nihon Ciba-Geigy K.K., IRGACURE I-184) (0.5 parts by mass) and isopropylalcohol (11 parts by mass) were thoroughly stirred and dispersed in a ball mill so as to have an average particle diameter of about 3 μm, to thereby a protective layer-coating liquid.

Next, the thus-prepared protective layer-coating liquid was applied with a wire bar onto the support on which the thermosensitive layer and the intermediate layer had been formed, followed by drying under heating at 90° C. for 1 min and then crosslinking with a UV lamp at 80 W/cm, to thereby form a protective layer having a thickness of about 4 μm.

(5) Antistatic Layer

—Preparation of Antistatic Layer-Coating Liquid—

A UV-curable conductive polymer (product of SHINETSU FINETECH CO., LTD., SEPLEGYDA HC-A04) (100 parts by mass), an initiator (product of Nihon Ciba-Geigy K.K., IRGACURE I-184) (0.6 parts by mass) and spherical filler having an average particle diameter of 15 μm (product of Soken Chemical & Engineering Co., Ltd., MX1500) (0.95 parts by mass) were thoroughly stirred in a ball mill to prepare an antistatic layer-coating liquid.

Next, the thus-prepared antistatic layer-coating liquid was applied with a wire bar onto the surface of the support opposite to the surface thereof where the thermosensitive layer, the intermediate layer and the protective layer had been formed, followed by drying under heating at 110° C. for 2 min and then crosslinking with a UV lamp at 80 W/cm, 10 m/min and 3 passes, to thereby form an antistatic layer.

Through the above procedure, a reversible thermosensitive recording medium of Example 1 was produced.

In the below-described manner, the thus-produced reversible thermosensitive recording medium of Example 1 was measured for the thickness of the antistatic layer.

Specifically, the antistatic layer-coating liquid excluding the spherical filler having an average particle diameter of 15 μm was applied with a wire bar (diameter: 0.15) on a whitish opaque polyester film having a thickness of 125 μm (product of Teijin DuPont Films Japan Limited, TETRON FILM U2L98W), followed by drying under heating at 110° C. for 2 min and then crosslinking with a UV lamp at 80 W/cm, 10 m/min and 2 passes, to thereby form an antistatic layer. Then, the thus-formed antistatic layer was measured for thickness with a stylus film thickness meter. As a result, the antistatic layer was found to have a thickness of 2.6 μm.

Furthermore, the reversible thermosensitive recording medium of Example 1 was evaluated for the following properties: the thickness of the antistatic layer, the ratio of the average particle diameter of the spherical filler to the thickness of the antistatic layer, the coverage of the surface of the antistatic layer with the spherical filler, and the surface resistance of the antistatic layer. The results are shown in Table 1.

<Evaluation Method>

The reversible thermosensitive recording medium of Example 1 was evaluated as follows.

<<Evaluation 1: Surface Resistance>>

A surface resistance meter (SIMCO Worksurface Tester ST-3) was placed on the antistatic layer surface of the reversible thermosensitive recording medium. Then, the resistance was measured under measurement conditions of 25° C.-60% RH. The results are shown in Table 1.

<<Evaluation 2: Curling Property>>

The reversible thermosensitive recording medium was repeatedly printed and erased 30 times in a rewritable printer (product of SINFONIA TECHNOLOGY CO., LTD., RP-K). Thirty minutes after, this reversible thermosensitive recording medium was placed on a horizontal table with the reversible thermosensitive recording layer facing upward, to measure the distances between the table and the four corners of the reversible thermosensitive recording medium. Next, it was placed on the table with the antistatic layer facing upward to measure the distances between the table and the four corners of the reversible thermosensitive recording medium. The results are shown in Table 1.

A: Curling<2 mm

B: 2 mm≤Curling<5 mm

C: 5 mm≤Curling<10 mm

D: 10 mm≤Curling

<<Evaluation 3: Sticking Property>>

Distilled water (50 mL) was dropped on the protective layer surface of the reversible thermosensitive recording medium. Separately, the reversible thermosensitive recording medium, which had been punched out to form a through hole, was placed thereon so that the antistatic layer surface thereof was brought into contact with the distilled water dropped on the protective layer surface. The resultant product of the two reversible thermosensitive recording media laminated via the distilled water was repeatedly treated with a rubber roller applying a load thereto until the distilled water did not outflow. A hook of a rod-like tension gauge was inserted into the through hole. In this state, the two reversible thermosensitive recording media were pulled in the horizontal direction until they were peeled off from each other. The maximum force (gf) at which the reversible thermosensitive recording media were peeled off from each other was measured. The results are shown in Table 1.

A: Maximum force<1,000 gf

B: 1,000 gf≤Maximum force<1,500 gf

C: 1,500 gf≤Maximum force<3,000 gf

D: 3,000 gf≤Maximum force

<<Evaluation 4: Scratch Formation>>

The reversible thermosensitive recording medium was repeatedly printed and erased 30 times in a rewritable printer (product of SINFONIA TECHNOLOGY CO., LTD., RP-K). This reversible thermosensitive recording medium was evaluated for scratches formed on the antistatic layer surface. The results are shown in Table 1.

A: No scratches were formed.

B: About 1 or 2 scratched lines were formed.

C: About 3 or 4 scratched lines were formed.

D: Numerous scratches were formed on the entire surface.

<<Evaluation 5: Conveyance Property>>

The reversible thermosensitive recording medium was repeatedly printed and erased 30 times in a rewritable printer (product of SINFONIA TECHNOLOGY CO., LTD., RP-K) for evaluating conveyance property thereof. The results are shown in Table 1.

A: The printer was not stopped due to conveyance failures (multi feed, jam).

B: The printer was stopped about once due to conveyance failures (multi feed, jam).

C: The printer was stopped about two or three times due to conveyance failures (multi feed, jam).

D: The printer was stopped four or more times due to conveyance failures (multi feed, jam).

<<Evaluation 6: Filler Exfoliation>>

The antistatic layer surface of the reversible thermosensitive recording medium was rubbed with nails several times. A piece of transparent adhesive tape was attached thereonto and then peeled off therefrom. The piece of tape was attached onto a black paper sheet to evaluate a degree of filler exfoliation. The results are shown in Table 1.

A: White powder could not be visually recognized.

B: A small amount of white powder could be visually recognized.

C: A large amount of white powder could be visually recognized.

D: White powder could be visually recognized at the time when the antistatic layer surface was rubbed with nails.

Examples 2 to 11

The procedure of Example 1 was repeated, except that the antistatic layer-coating liquid was changed to antistatic layer-coating liquids having compositions shown in Tables 1 and 2, to thereby produce reversible thermosensitive recording media of Examples 2 to 11. The thus-produced reversible thermosensitive recording media were evaluated in the same manner as described above. The results are shown in Tables 1 and 2.

Comparative Examples 1 to 4

The procedure of Example 1 was repeated, except that the antistatic layer-coating liquid was changed to antistatic layer-coating liquids having compositions shown in Table 2, to thereby produce reversible thermosensitive recording media of Comparative Examples 1 to 4. The thus-produced reversible thermosensitive recording media were evaluated in the same manner as described above. The results are shown in Table 2.

Comparative Example 5

The procedure of Example 1 was repeated, except that the antistatic layer-coating liquid was changed to a back layer liquid (liquid E) described in Example 13 of JP-A No. 2006-240199, to thereby produce a reversible thermosensitive recording medium. The thus-produced reversible thermosensitive recording medium was evaluated in the same manner as described above. The results are shown in Table 2.

[Liquid E: Back Layer Liquid]

α-Ethyl(trimethylammonium)alkanoyl ester (product of Nippon Pure Chemical K.K., SAT-5): 39 parts by mass Methanol: 60 parts by mass Crosslinked polystyrene particles (product of Soken Chemical & Engineering Co., Ltd., SGP50C, average particle diameter: 10 μm): 1 part by mass

Comparative Example 6

The procedure of Example 1 was repeated, except that the antistatic layer-coating liquid was changed to a back layer liquid (liquid F) described in Example 14 of JP-A No. 2006-240199, to thereby produce a reversible thermosensitive recording medium. The thus-produced reversible thermosensitive recording medium was evaluated in the same manner as described above. Here, the number of the fillers contained in the back layer was found to be about 700/$m^2$. The results are shown in Table 2.

[Liquid F: Back Layer Liquid]

α-Ethyl(trimethylammonium)alkanoyl ester (product of Nippon Pure Chemical K.K., SAT-5): 37 parts by mass Methanol: 60 parts by mass Crosslinked PMMA particles (product of Soken Chemical & Engineering Co., Ltd., MX1000, average particle diameter: 10 μm): 3 parts by mass

Comparative Example 7

The procedure of Example 1 was repeated, except that the antistatic layer-coating liquid was not applied to form no antistatic layer, to thereby a reversible thermosensitive recording medium. The thus-produced reversible thermosensitive recording medium was evaluated in the same manner as described above. The results are shown in Table 2.

TABLE 1

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| ASCL | | | | | | | | | | |
| Conductive polymer [SEPLEGYDA HC-A04] | | 100 | 100 | 100 | 100 | 100 | 100 | 100 | 100 | 100 |
| Initiator | I-184 | 0.6 | — | — | 0.9 | — | — | 1.2 | — | — |
| | I-127 | — | 0.9 | — | — | 1.2 | — | — | 0.9 | — |
| | I-907 | — | — | 1.2 | — | — | 0.6 | — | — | 0.6 |
| Spherical filler | MX1000 | — | — | — | — | — | 0.95 | — | 0.96 | — |
| | MX1500 | 0.95 | 0.96 | 0.97 | 0.63 | 1.64 | — | — | — | — |
| | MX2000 | — | — | — | — | — | — | 1.30 | — | 1.28 |
| | MX2500 | — | — | — | — | — | — | — | — | — |
| | APD (μm): d | 15 | 15 | 15 | 15 | 15 | 10 | 20 | 10 | 20 |
| Thickness of antistatic layer (μm): t | | 2.6 | 3.0 | 3.6 | 3.0 | 3.0 | 2.0 | 4.0 | 1.7 | 5.0 |
| d/t | | 5.8 | 5.0 | 4.2 | 5.0 | 5.0 | 5.0 | 5.0 | 5.9 | 4.0 |
| Coverage with spherical filler (%) | | 4.2 | 4.2 | 4.2 | 2.3 | 9.5 | 6.0 | 4.2 | 6.0 | 5.0 |
| Surface resistance (Ω/sq.) | | $1.3 \times 10^6$ | $7.9 \times 10^5$ | $3.2 \times 10^5$ | $6.3 \times 10^5$ | $6.3 \times 10^8$ | $2.0 \times 10^7$ | $1.3 \times 10^5$ | $1.0 \times 10^5$ | $1.0 \times 10^5$ |
| Curling property | | B | B | B | A | B | B | B | B | B |
| Sticking property | | B | A | B | A | A | A | A | B | B |
| Scratch formation | | A | A | A | A | A | A | A | B | A |
| Conveyance property | | B | A | B | A | A | A | A | B | B |
| Filler exfoliation | | A | A | A | A | A | A | B | A | B |

In Table 1, "ASCL" means antistatic layer-coating liquid. and "APD" means average particle diameter. Also, the units of the amounts of the conductive polymer, the initiator and the spherical filler are parts by mass.

TABLE 2

| | | Ex. 10 | Ex. 11 | Co. Ex. 1 | Co. Ex. 2 | Co. Ex. 3 | Co. Ex. 4 | Co. Ex. 5 | Co. Ex. 6 | Co. Ex. 7 |
|---|---|---|---|---|---|---|---|---|---|---|
| ASCL | | | | | | | | | | |
| Conductive polymer [SEPLEGYDA HC-A04] | | 100 | 100 | 100 | 100 | 100 | 100 | — | — | — |
| Initiator | I-184 | — | — | — | — | — | — | — | — | — |
| | I-127 | 0.9 | 0.9 | 0.9 | 0.9 | 0.9 | 0.9 | — | — | — |
| | I-907 | — | — | — | — | — | — | — | — | — |
| Spherical filler | MX1000 | — | — | — | — | 0.63 | 1.63 | — | — | — |
| | MX1500 | 1.63 | — | 0.96 | 0.96 | — | — | — | — | — |
| | MX2000 | — | — | — | — | — | — | — | — | — |
| | MX2500 | — | 0.96 | — | — | — | — | — | — | — |
| | APD (μm): d | 15 | 25 | 15 | 15 | 10 | 10 | 10 | 10 | — |
| Thickness of antistatic layer (μm): t | | 3.0 | 5.1 | 4.0 | 2.4 | 3.0 | 3.0 | 3.0 | 3.0 | — |
| d/t | | 5.0 | 4.9 | 3.8 | 6.3 | 3.3 | 3.3 | 3.3 | 3.3 | — |
| Coverage with spherical filler (%) | | 10.3 | 2.0 | 4.2 | 4.2 | 1.8 | 10.3 | (4) | (18) | — |
| Surface resistance (Ω/sq.) | | $1.3 \times 10^9$ | $1.3 \times 10^6$ | $1.3 \times 10^5$ | $1.3 \times 10^6$ | $6.3 \times 10^5$ | $5.3 \times 10^6$ | $6.3 \times 10^9$ | $6.3 \times 10^9$ | $6.3 \times 10^{13}$ |
| Curling property | | B | C | B | B | B | B | D | D | D |
| Sticking property | | B | A | C | C | D | D | D | D | D |
| Scratch formation | | B | A | C | C | D | D | D | D | D |
| Conveyance property | | B | A | D | C | D | D | B | B | C |
| Filler exfoliation | | C | C | B | C | B | B | D | D | — |

In Table 2, the values in parentheses are expected values, and "Co. Ex." means "Comparative Example." Also, "ASCL" and "APD" have the same meanings as in Table 1, and the units of the amounts of the conductive polymer, the initiator and the spherical filler are parts by mass.

REFERENCE SIGNS LIST

1: Reversible thermosensitive recording medium
10: Reversible thermosensitive recording member
11: Support
13: Reversible thermosensitive recording layer
14: Intermediate layer
15: Protective layer
16: Back layer
21: Reversible thermosensitive recording card (reversible thermosensitive recording member)
22: Reversible display section
23: Printable section
24: Back layer

25: Recessed portion
26: Reversible display section
27: IC chip
30: Outlet/Inlet
31: Conveyance roller
32: Guide roller
33: Sensor
34: Magnetic head
34*c*: Controlling unit
35: Platen roller
36: Guide roller
37: Conveyance roller
38: Ceramic heater
38*c*: Ceramic heater controlling unit
39: Guide roller
40: Conveyance roller
43: Sensor
43*a*: Sensor
44: Platen roller
45: Conveyance roller
46: Conveyance roller
47: Conveyance roller
48: Conveyance belt
49*b*: Conveyance path
50: Conveyance path
51: Sensor
52: Platen roller
53: Thermal head
53*c*: Thermal head controlling unit
55*a*: Conveyance path switching unit
55*b*: Conveyance path switching unit
56*a*: Conveyance path
56*b*: Conveyance path
57*a*: Limit switch
57*b*: Limit switch
58: Conveyance belt
59: Conveyance roller
60: Guide roller
61: Outlet
81: IC chip
82: Antenna
85: RF-ID tag
90: Industrial rewritable sheet (reversible thermosensitive recording member)
94: Ceramic heater
95: Thermal head
96: Heat roller
97: Tray
98: Thermosensitive reversible recording medium (rewritable sheet)
99: RF-ID reader/writer
100: Image processing apparatus
232: Wafer substrate
233: Integrated circuit
234: Contact terminal

The invention claimed is:

1. A reversible thermosensitive recording medium comprising:
a support,
a reversible thermosensitive recording layer provided on the support and
an antistatic layer,
wherein the antistatic layer is provided on at least one of the reversible thermosensitive recording layer and a surface of the support opposite to the surface thereof on which the reversible thermosensitive recording layer is provided,
wherein the antistatic layer contains spherical fillers and a curable conductive polymer, and
wherein the spherical fillers satisfy the following Expression (1):

$$4 \leq \frac{\text{average particle diameter of the spherical fillers}}{\text{thickness of the antistatic layer}} \leq 6. \quad \text{Expression (1)}$$

2. The reversible thermosensitive recording medium according to claim wherein a surface of the antistatic layer is covered with the spherical fillers at a coverage of 2% to 10%.

3. The reversible thermosensitive recording medium according to claim 1, wherein the average particle diameter of the spherical fillers is 10 μm to 20 μm.

4. The reversible thermosensitive recording medium according claim 1, wherein the thickness of the antistatic layer is 1 μm to 5 μm.

5. The reversible thermosensitive recording medium according to claim 1, wherein the antistatic layer has a surface resistance of $1\times10^{9}\Omega$/sq. or lower.

6. The reversible thermosensitive recording medium according to claim 1, wherein the curable conductive polymer is a UV-curable conductive polymer.

7. The reversible thermosensitive recording medium according to claim 6, wherein the UV-curable conductive polymer has at least one main skeleton selected from the group consisting of polythiophene, polyparaphenylene, polyaniline and polypyrrole.

8. The reversible thermosensitive recording medium according to claim 1, wherein the reversible thermosensitive recording layer contains an electron donating coloring compound and an electron accepting compound.

9. The reversible thermosensitive recording medium according to claim 1, wherein the reversible thermosensitive recording medium is processed into a card or a sheet.

10. A reversible thermosensitive recording member comprising:
an information storage section, and
a reversible display section,
wherein the reversible display section contains the reversible thermosensitive recording medium,
wherein the reversible thermosensitive recording medium comprises:
a support,
a reversible thermosensitive recording layer provided on the support and
an antistatic layer,
wherein the antistatic layer is provided on at least one of the reversible thermosensitive recording layer and a surface of the support opposite to the surface thereof on which the reversible thermosensitive recording layer is provided,
wherein the antistatic layer contains spherical fillers and a curable conductive polymer, and
wherein the spherical tillers satisfy the following Expression (1):

$$4 \leq \frac{\text{average particle diameter of the spherical fillers}}{\text{thickness of the antistatic layer}} \leq 6. \quad \text{Expression (1)}$$

11. The reversible thermosensitive recording member according to claim 10, wherein the information storage section and the reversible display section are integrated.

12. The reversible thermosensitive recording member according to claim 10, further comprising a printable section.

* * * * *